US010405655B2

(12) United States Patent
Nelson et al.

(10) Patent No.: US 10,405,655 B2
(45) Date of Patent: Sep. 10, 2019

(54) FURNITURE ASSEMBLY, IMPLEMENT INTERLOCK SYSTEM AND CABLE GUIDE

(71) Applicant: Sauder Woodworking Co., Archbold, OH (US)

(72) Inventors: Richard A. Nelson, Napoleon, OH (US); Amy L. Kruse, Defiance, OH (US)

(73) Assignee: SAUDER WOODWORKING CO., Archbold, OH (US)

( * ) Notice: Subject to any disclaimer, the term of this patent is extended or adjusted under 35 U.S.C. 154(b) by 0 days.

(21) Appl. No.: 15/695,547

(22) Filed: Sep. 5, 2017

(65) Prior Publication Data

US 2019/0069673 A1 Mar. 7, 2019

(51) Int. Cl.

*A47B 88/75* (2017.01)
*A47B 88/497* (2017.01)
*E05B 65/466* (2017.01)

(52) U.S. Cl.

CPC ..... *A47B 88/75* (2017.01); *A47B 88/497* (2017.01); *E05B 65/466* (2013.01); *A47B 2088/76* (2017.01)

(58) Field of Classification Search

CPC ..... A47B 88/50; A47B 88/57; A47B 88/75; A47B 88/467; A47B 88/497; A47B 88/70; A47B 2088/76; E05B 65/463; E05B 65/466

USPC ..... 312/216, 217, 221

See application file for complete search history.

(56) References Cited

U.S. PATENT DOCUMENTS

| | | | | |
|---|---|---|---|---|
| RE26,902 | E * | 5/1970 | Levenberg | E05B 65/466 312/221 |
| 3,941,441 | A * | 3/1976 | Scheerhorn | E05B 65/466 312/215 |
| 5,392,951 | A * | 2/1995 | Gardner | E05B 65/46 221/125 |
| 6,170,927 | B1 | 1/2001 | Dykstra et al. | |
| 2004/0217679 | A1 * | 11/2004 | Mizrahi | A47B 88/467 312/330.1 |
| 2010/0295433 | A1 | 11/2010 | Randall | |

FOREIGN PATENT DOCUMENTS

| | | | |
|---|---|---|---|
| DE | 20118675 | U1 | 5/2002 |
| DE | 102004021105 | A1 | 11/2005 |
| EP | 1346663 | A1 | 9/2003 |

* cited by examiner

*Primary Examiner* — James O Hansen

(74) *Attorney, Agent, or Firm* — Honigman LLP; Douglas H. Siegel

(57) ABSTRACT

A furniture assembly is disclosed that includes an article of furniture, two or more implements and an implement interlock system. The article of furniture includes at least one panel defining an implement-receiving cavity. The two or more implements are slidably-disposed within the implement-receiving cavity of the article of furniture. The implement interlock system includes: two or more cable guides attached to the at least one panel; a cable engagement device attached to each implement of the two or more implements; and a cable tensioning device, including a cable, attached to the at least one panel. A portion of a length of the cable extends through the two or more cable guides and is selectively-hooked by the cable engagement device attached to each implement of the two or more implements. An implement interlock system and a cable guide also are disclosed.

18 Claims, 32 Drawing Sheets

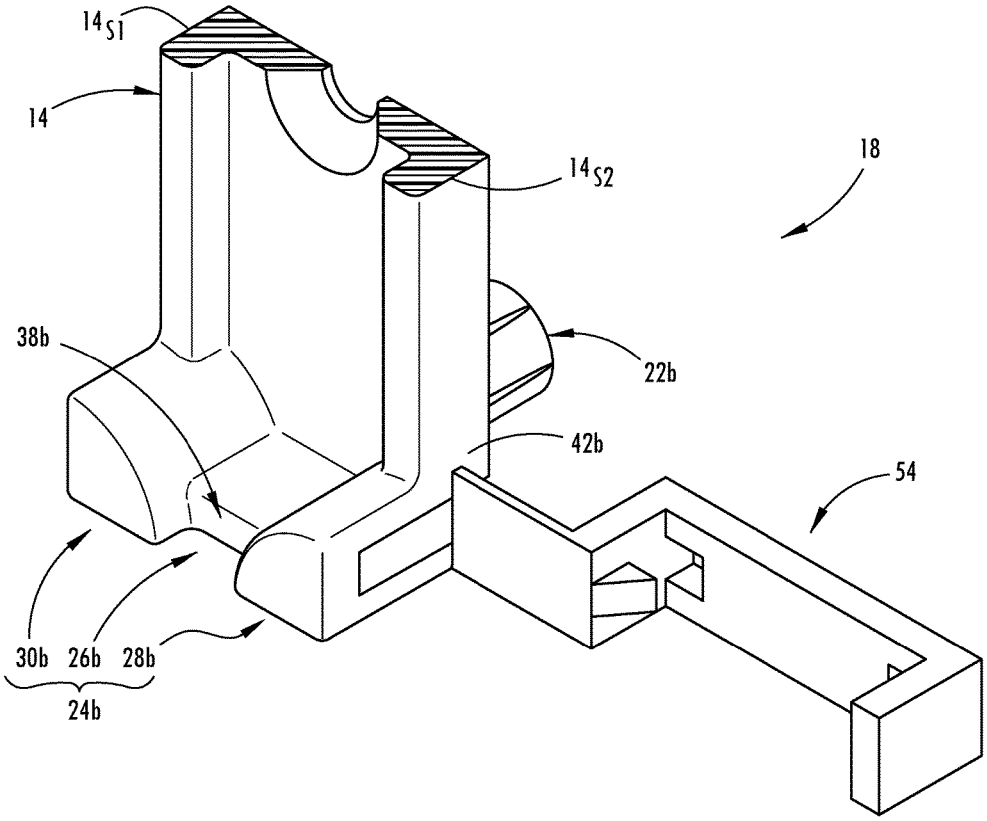
FIG. 1A"

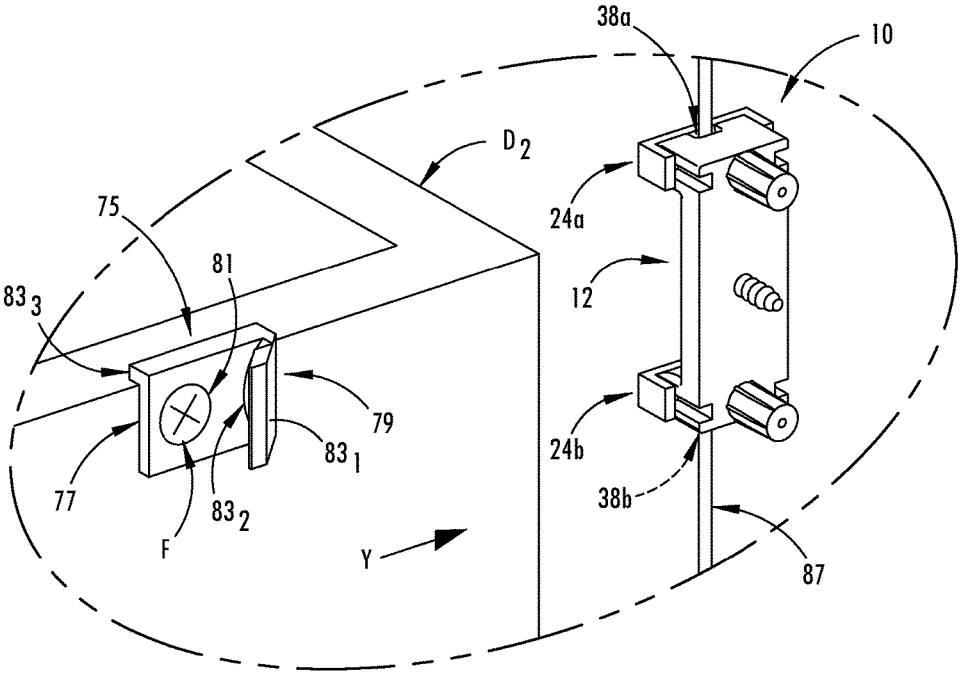
FIG. 21'
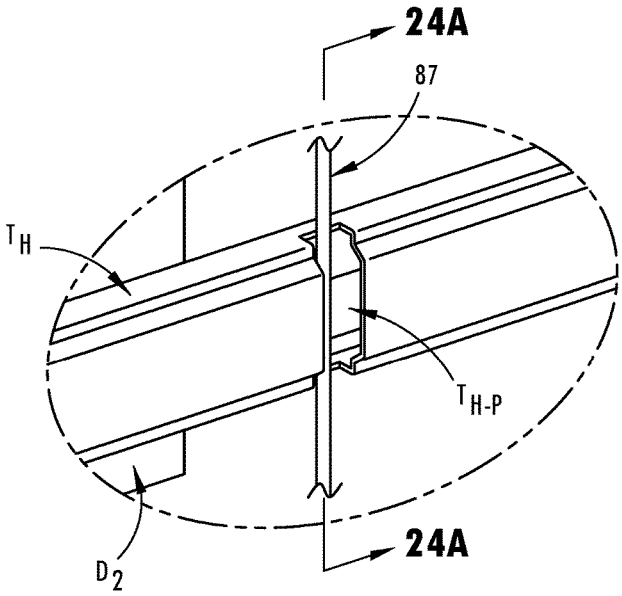
FIG. 21"

FURNITURE ASSEMBLY, IMPLEMENT INTERLOCK SYSTEM AND CABLE GUIDE

FIELD

The present disclosure relates generally to a furniture assembly, implement interlock system and cable guide.

BACKGROUND

This section provides background information related to the present disclosure which is not necessarily prior art.

Furniture assemblies, implement interlock systems and cable guides are known. While existing furniture assemblies, implement interlock systems and cable guides perform adequately for their intended purpose, improvements to furniture assemblies, implement interlock systems and cable guides are continuously being sought in order to advance the arts.

SUMMARY

This section provides a general summary of the disclosure, and is not a comprehensive disclosure of its full scope or all of its features.

One aspect of the disclosure provides a furniture assembly. The furniture assembly includes an article of furniture, two or more implements and an implement interlock system. The article of furniture includes at least one panel defining an implement-receiving cavity. The two or more implements are slidably-disposed within the implement-receiving cavity of the article of furniture. The implement interlock system includes: two or more cable guides attached to the at least one panel; a cable engagement device attached to each implement of the two or more implements; and a cable tensioning device attached to the at least one panel. The cable tensioning device includes a cable having a proximal end and a distal end. The proximal end of the cable is attached to the cable tensioning device. The distal end of the cable is attached to the at least one panel. A portion of a length of the cable extends through the two or more cable guides and is selectively-hooked by the cable engagement device attached to each implement of the two or more implements.

Implementations of the disclosure may include one or more of the following optional features. For example, the article of furniture is a dresser cabinet. The two or more implements may be two or more drawers slidably-disposed within the dresser cabinet. Each implement of the two or more implements may include a pair of first track members, the article of furniture may include two or more pairs of second track members, at least one second track member of the two or more pairs of second track members may define a cable-receiving passage, and the cable may extend through the cable-receiving passage.

In some examples, the at least one panel defines at least one fastener bore that is sized for receiving at least one fastener that passes through at least one attachment hardware bore formed by each cable guide of the two or more cable guides.

In some instances, the at least one panel defines at least one attachment projection bore that is sized for receiving at least one attachment projection extending from each cable guide of the two or more cable guides.

In some implementations, the cable tensioning device includes a casing having a base portion and cable-stowing housing. The base portion defines one or more attachment hardware bores extending through the base portion that is sized for receiving at least one fastener for attaching each cable guide to the at least one panel.

In some examples, the cable tensioning device includes cable tensioner for biasing the cable within the cable-stowing housing in a wound orientation.

In some instances, a locating ledge of each cable engagement device is disposed upon a surface of each implement of the two or more implements. Each cable engagement device defines a hardware bore that is sized for receiving a fastener that secures each cable engagement device to each implement of the two or more implements.

Another aspect of the disclosure provides an implement interlock system for selectively attaching two or more implements in a slidable relationship with respect to a cavity defined by at least one panel that forms an implement housing. The implement interlock system includes a cable tensioning device, two or more cable guides and two or more cable engagement devices. The cable tensioning device includes a cable. The cable includes a proximal end and a distal end. The proximal end of the cable is attached to the cable tensioning device. The cable is defined by a length extending between the proximal end of the cable and the distal end of the cable. The two or more cable guides define at least one cable-receiving passageway. A portion of a length of the cable extends through the at least one cable-receiving passageway. The two or more cable engagement devices selectively-hooks the portion of a length of the cable.

Implementations of the disclosure may include one or more of the following optional features. For example, each cable guide of the two or more cable guides defines at least one attachment hardware bore that is sized for receiving at least one fastener for attaching each cable guide to the at least one panel.

In some examples, each cable guide of the two or more cable guides includes at least one attachment projection that is sized for being disposed within at least one attachment projection bore formed by the at least one panel.

In some instances, the cable tensioning device includes a casing having a base portion and cable-stowing housing. The base portion defines at least one attachment hardware bore extending through the base portion that is sized for receiving at least one fastener for attaching each cable guide to the at least one panel.

In some implementations, the cable tensioning device includes a cable-stowing housing and a cable tensioner disposed within the cable-stowing housing. The cable tensioner is connected to the cable for biasing the cable within the cable-stowing housing in a wound orientation.

In some implementations, a locating ledge of each cable engagement device is sized for interfacing with a surface of each implement of the two or more implements. Each cable engagement device defines a hardware bore that is sized for receiving a fastener that secures each cable engagement device to each implement of the two or more implements.

Yet another aspect of the disclosure provides a cable guide. The cable guide includes a body having: a central body portion including an upper end and a lower end; an upper body portion extending from the upper end of the central body portion; and a lower body portion extending from the lower end of the central body portion. Each of the upper body portion and the lower body portion defines: a cable-receiving passageway; an upper cable-retaining body extending away from the upper body portion; and a lower cable-retaining body extending away from the lower body portion.

Implementations of the disclosure may include one or more of the following optional features. For example, each of the upper cable-retaining body and the lower cable-retaining body includes a tether portion and a clamping portion. The tether portion of the upper cable-retaining body extends away from the upper body portion. The tether portion of the lower cable-retaining body extends away from the lower body portion.

In some examples, each of the upper body portion and the lower body portion is defined by an end portion including: a central portion; a first side portion; and a second side portion.

In some instances, the central portion extends away from a front surface of the central body portion at a first height. Each of the first side portion and the second side portion extend away from the front surface of the central body portion at a second height. The first height is less than the second height. A height difference of the first height and the second height defines the cable-receiving passageway.

In some implementations, the cable guide further includes an attachment hardware bore extending through a thickness of the central body portion.

In some examples, the cable guide further includes one or more attachment projections.

In some instances, each of the upper cable-retaining body and the lower cable-retaining body are respectively arrangeable relative the upper body portion and the lower body portion in: an open orientation and a closed orientation.

In some implementations, an outer surface of the body defines at least one barb-receiving recess.

In some examples, each of the upper cable-retaining body and the lower cable-retaining body includes at least one barb that is sized for being received within the at least one barb-receiving recess for retaining each of the upper cable-retaining body and the lower cable-retaining body in the closed orientation.

The details of one or more implementations of the disclosure are set forth in the accompanying drawings and the description below. Other aspects, features, and advantages will be apparent from the description and drawings, and from the claims.

DESCRIPTION OF THE DRAWINGS

The drawings described herein are for illustrative purposes only of selected embodiments and not all possible implementations, and are not intended to limit the scope of the present disclosure.

FIG. 1A' is an enlarged view according to line 1A' of FIG. 1A.

FIG. 1A" is a cross-sectional view according to line 1A'-1A' of FIG. 1A.

FIG. 21' and FIG. 21" are enlarged views according to line 21' and line 21", respectively, of FIG. 21.

FIG. 22' and FIG. 22" are enlarged views according to line 22' and line 22" respectively, of FIG. 22.

FIG. 23' is an enlarged view according to line 23' of FIG. 23.

Corresponding reference numerals indicate corresponding parts throughout the several views of the drawings.

DETAILED DESCRIPTION

Figure 1A:
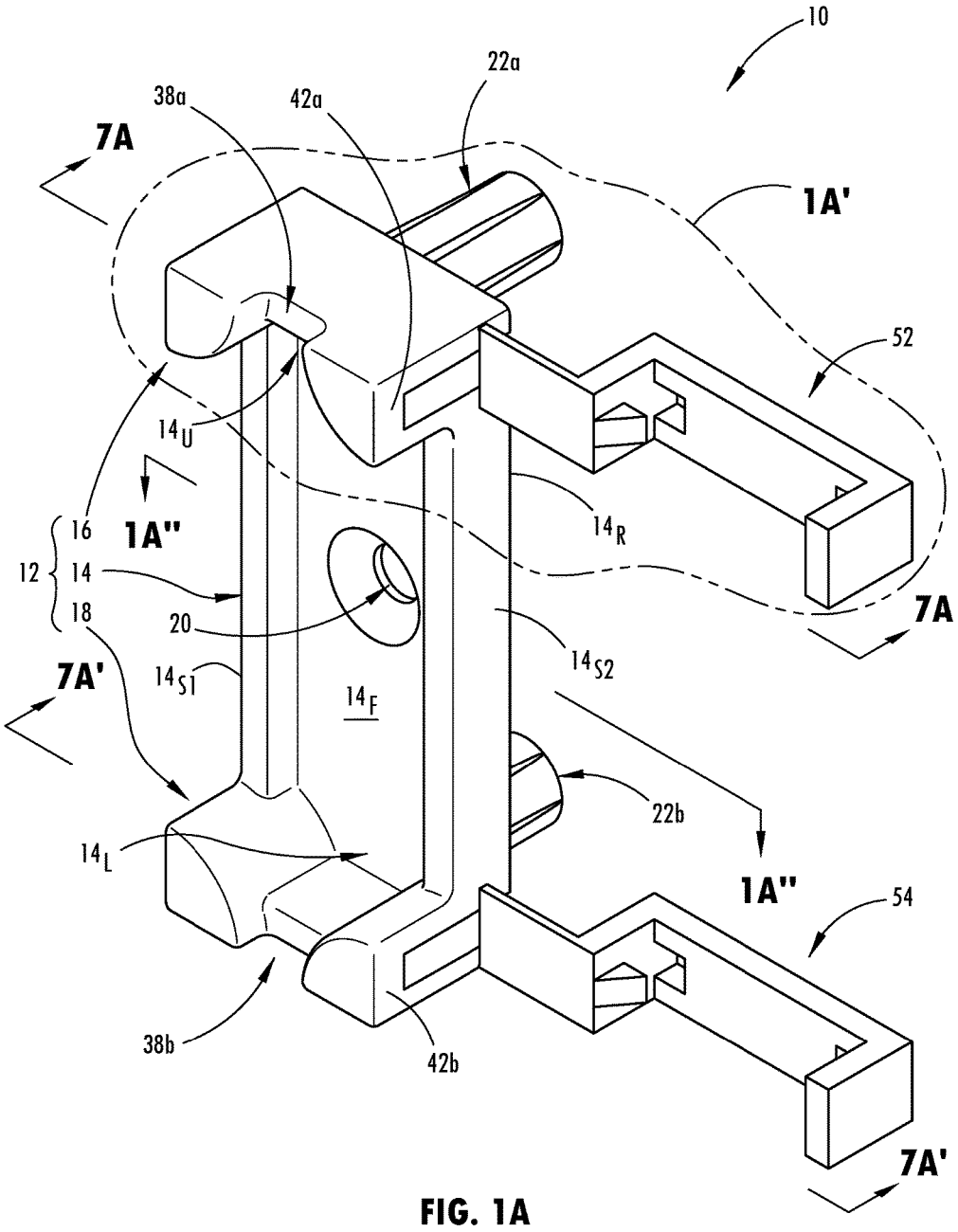
FIG. 1A is a perspective view of an exemplary cable guide arranged in first orientation.
Figure 1A:
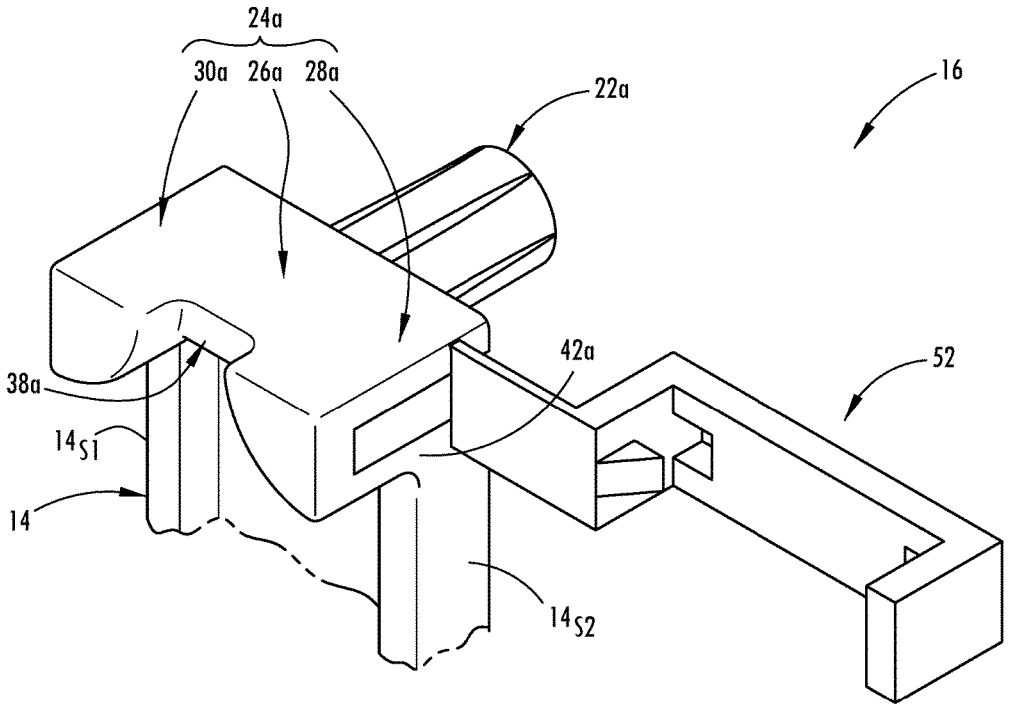
Figure 1B:
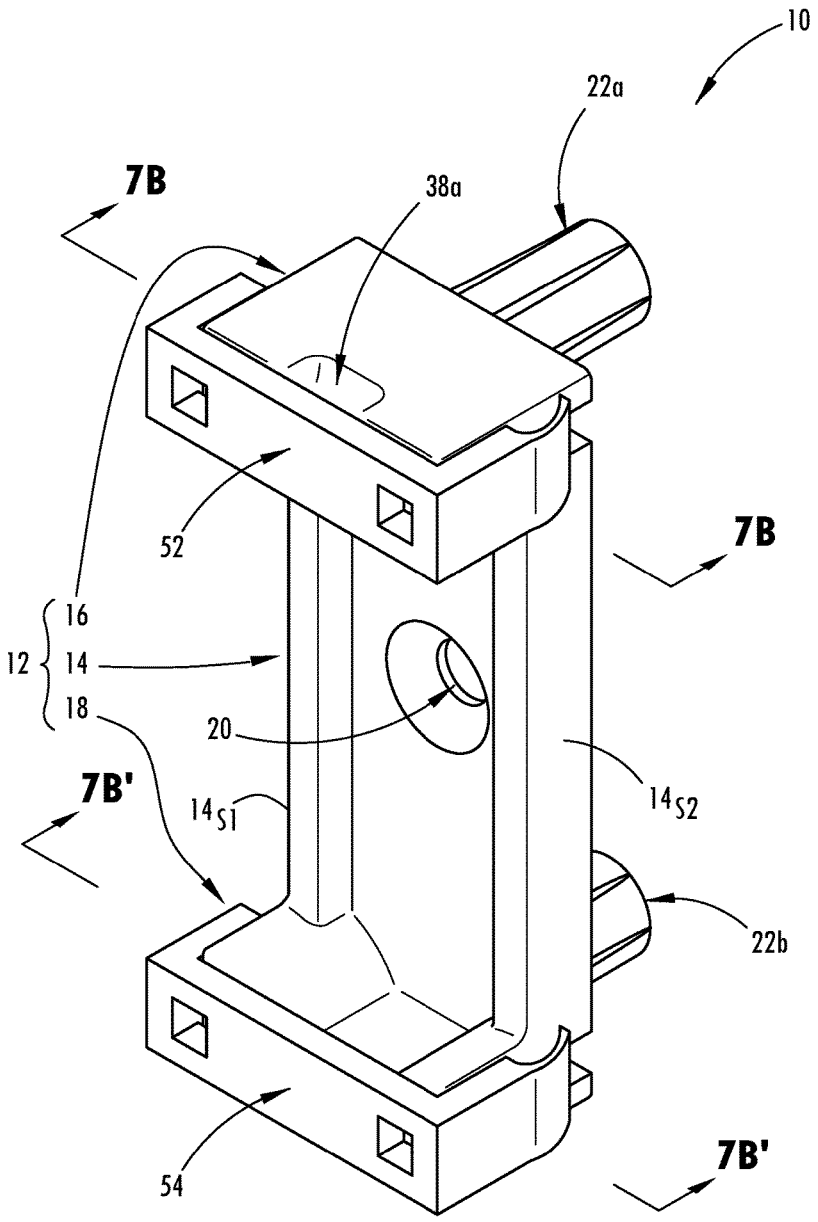
FIG. 1B is a perspective view of the cable guide of FIG. 1A arranged in second orientation.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or sheet is referred to as being "on," "engaged to," "connected to," or "coupled to" another element or sheet, it may be directly on, engaged, connected or coupled to the other element or sheet, or intervening elements or sheets may be present. In contrast, when an element is referred to as being "directly on," "directly engaged to," "directly connected to," or "directly coupled to" another element or sheet, there may be no intervening elements or sheets present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, sheets and/or sections, these elements, components, regions, sheets and/or sections should not be limited by these terms. These terms may be only used to distinguish one element, component, region, sheet or section from another region, sheet or section. Terms such as "first," "second," and other numerical terms when used herein do not imply a sequence or order unless clearly indicated by the context. Thus, a first element, component, region, sheet or section discussed below could be termed a second element, component, region, sheet or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 12:
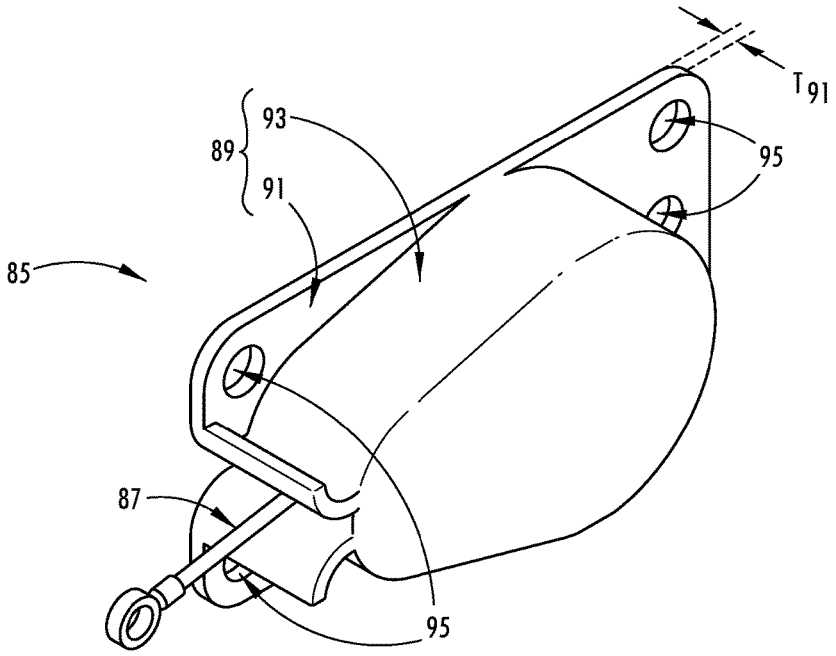
FIG. 12 is a perspective view of an exemplary cable tensioning device.
Figure 13:
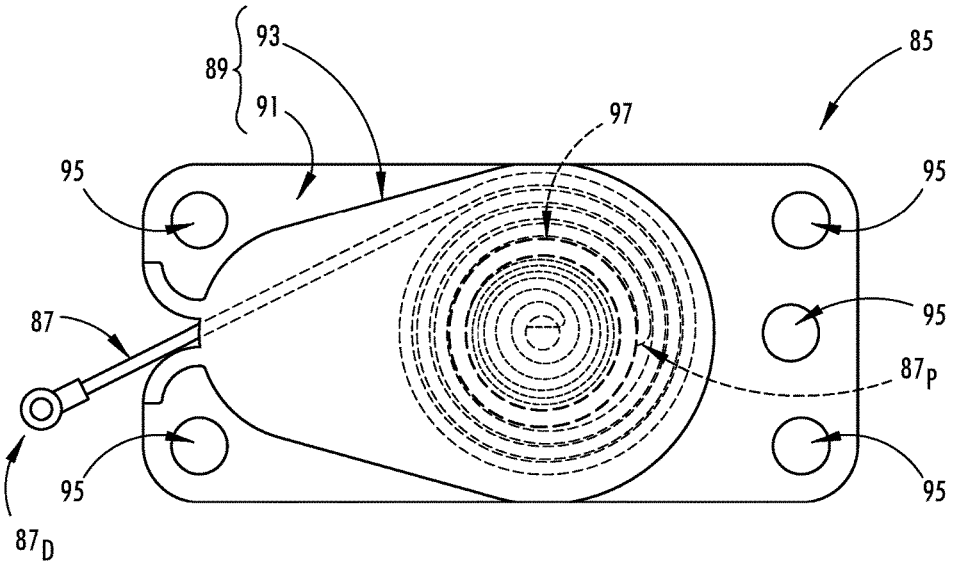
FIG. 13 is a front view of the cable tensioning device of FIG. 12.
Figure 15:
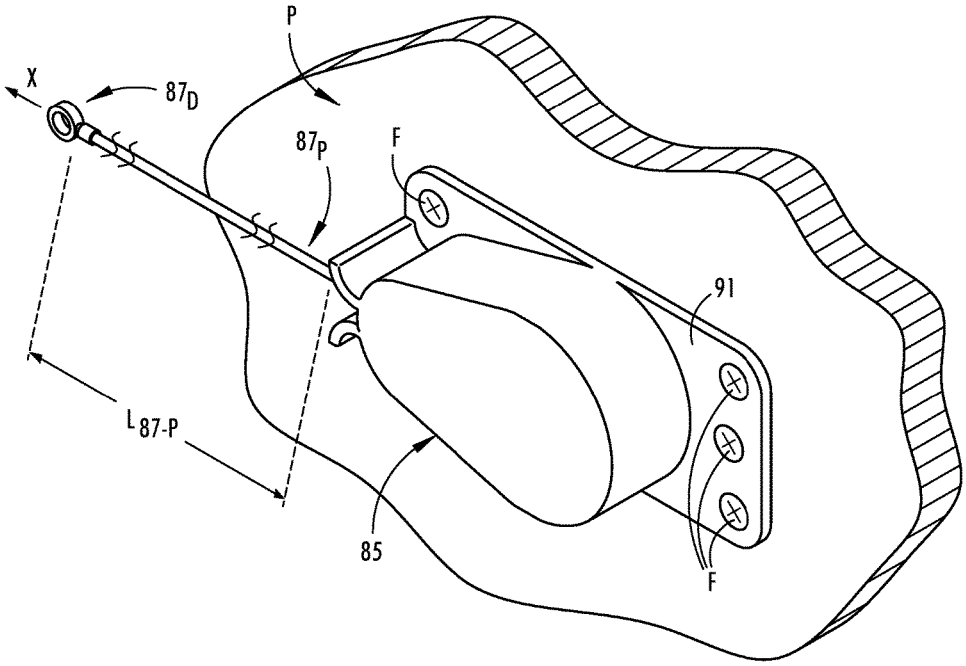
FIG. 15 is an assembled view of the exemplary subassembly of FIG. 14.

With reference to FIGS. 1A-8A and 1B-8B, an exemplary cable guide is shown generally at 10. Furthermore, an exemplary cable engagement device is shown generally at 75 in FIGS. 9-11. Yet even further, a cable tensioning device 85 including a cable 87 having a length $L_{87}$ is also shown in FIGS. 12-13 and 15.

Figure 20:
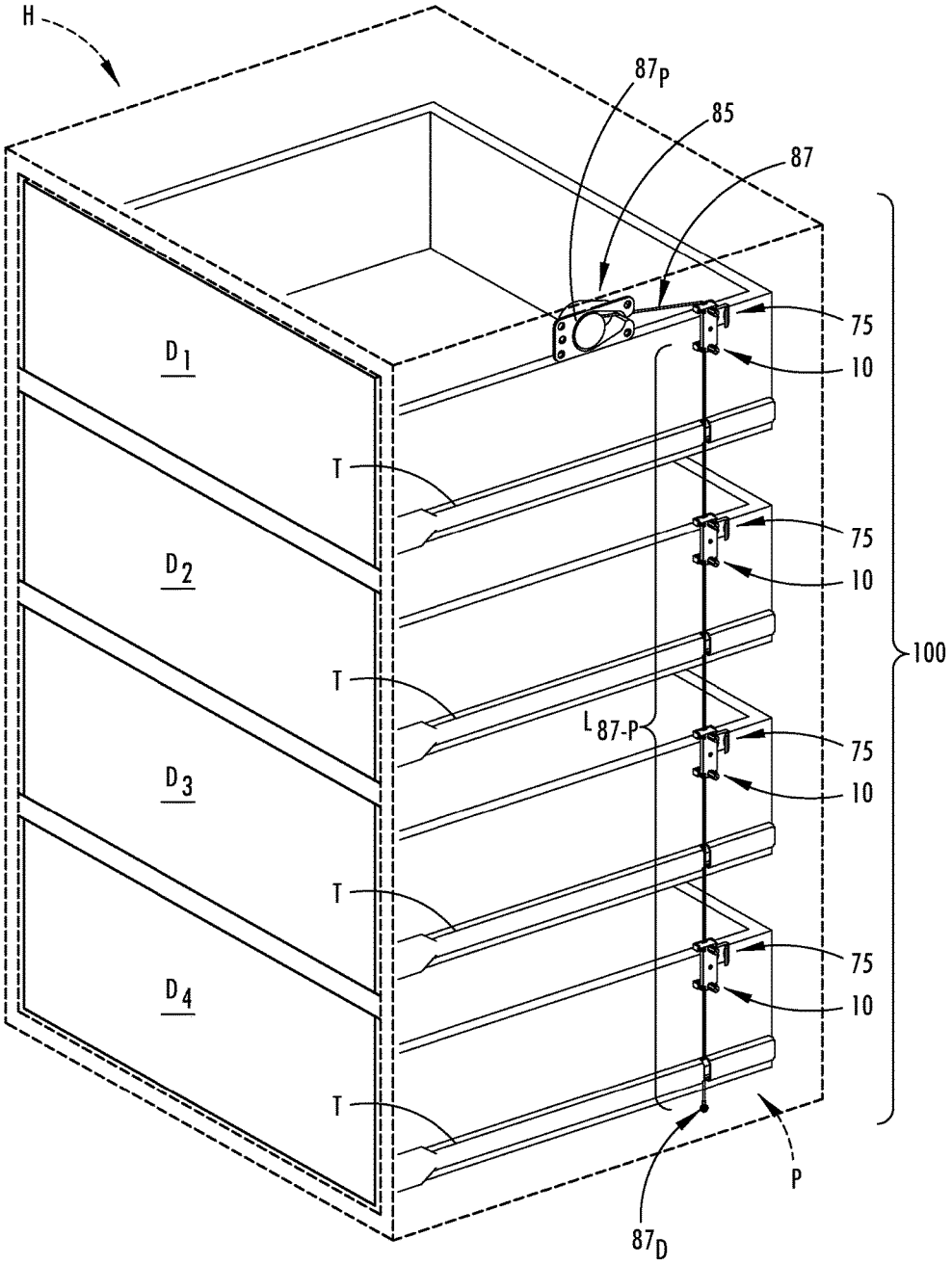
FIG. 20 is a perspective view of an exemplary interlock system secured to an article of furniture.

As seen in FIG. 20, two or more cable guides 10, two or more cable engagement devices 75 and the cable tensioning device 85 cooperate to define an implement interlock system 100 for interlocking two or more implements $D_1$-$D_4$ (e.g., two or more moveable components of an article of furniture, such as, for example, drawers) that are movably-secured to an implement housing H (e.g., a stationary component of an article of furniture such as, for example, a dresser cabinet defining a cavity for storing the two or more drawers $D_1$-$D_4$). With reference to FIGS. 25A-25D, the implement interlock system 100 permits a first drawer (see, e.g., $D_2$ in FIGS. 25A-25D) of the two or more drawers $D_1$-$D_4$ to transition from a nested orientation (see, e.g., FIG. 25A) within the dresser cabinet H to a fully slid outwardly orientation (see, e.g., FIG. 25B) outside of the dresser cabinet H while also preventing a second drawer (see, e.g., $D_3$ in FIGS. 25A-25D) of the two or more drawers $D_1$-$D_4$ to also be arranged in a fully slid outwardly orientation outside of the dresser cabinet H. Accordingly, if a user attempts to move the second drawer $D_3$ of the two or more drawers $D_1$-$D_4$ from the nested orientation (see, e.g., FIG. 25B) within the dresser cabinet H toward a fully slid outwardly orientation (see, e.g., FIG. 25D) outside of the dresser cabinet H while the first drawer $D_2$ is already arranged in the fully slid outwardly orientation outside of the dresser cabinet H, this movement of the second drawer $D_3$ either will be prevented or retarded, or the implement interlock system 100 will automatically retract (see, e.g., FIGS. 25C-25D) the previously extended first drawer $D_2$ of the two or more drawers $D_1$-$D_4$ from the fully slid outwardly orientation (see, e.g., FIG. 25B) outside of the dresser cabinet H back to the nested orientation (see, e.g., FIG. 25D) within the dresser cabinet H. If the movement of drawer $D_3$ is prevented, then the user must move the first drawer $D_2$ to the nested orientation prior to transitioning the second drawer $D_3$ toward a fully slid outwardly orientation.

Referring to FIGS. 1A-8B, the cable guide 10 is now described. As seen in FIG. 1A, the cable guide 10 includes a body 12 having a central body portion 14, an upper body portion 16 and a lower body portion 18.

In an example, the central body portion 14 may be defined by a substantially rectangular shape having a thickness $T_{14}$ (see, e.g., FIGS. 8A-8B) extending between a front surface $\mathbf{14}_F$ of the central body portion 14 and a rear surface $\mathbf{14}_R$ of the central body portion 14. The central body portion 14 is further defined by a length $L_{14}$ (see, e.g., FIGS. 2A, 8A-8B) extending between an upper end $\mathbf{14}_U$ of central body portion 14 and a lower end $\mathbf{14}_L$ of central body portion 14. The central body portion 14 is further defined by a width $W_{14a}$, $W_{14b}$ (see, e.g., FIGS. 2A, 7A, 7A') extending between a first side surface $\mathbf{14}_{S1}$ of central body portion 14 and a second side surface $\mathbf{14}_{S2}$ of central body portion 14.

Figure 16:
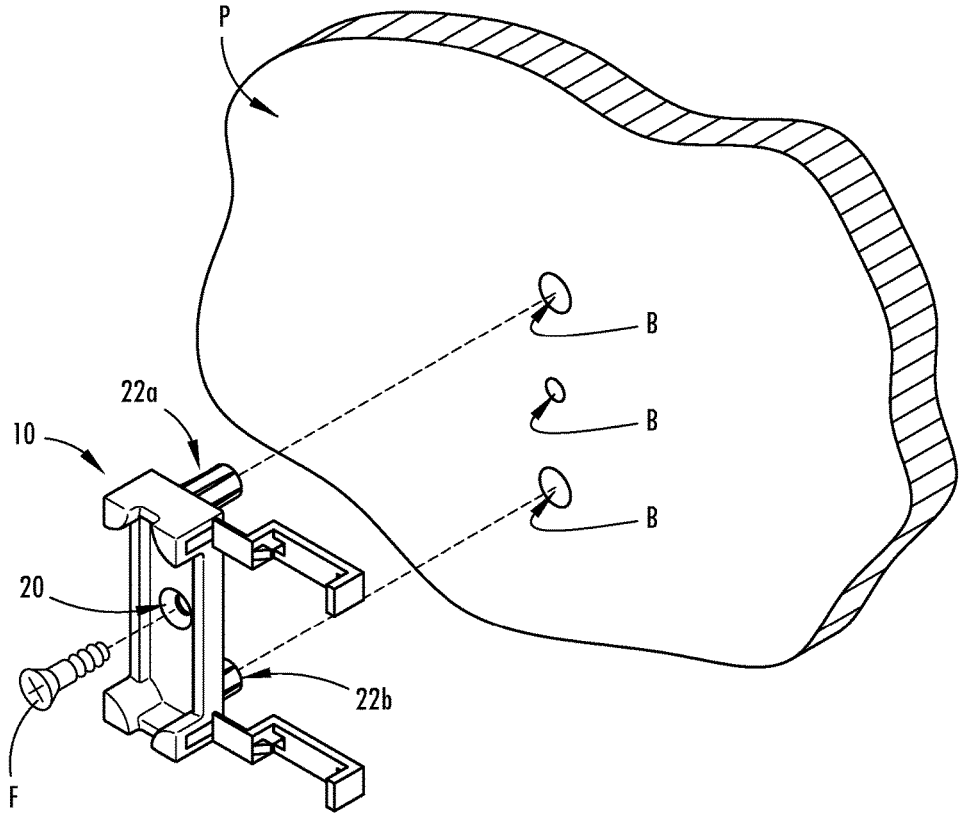
FIG. 16 is an exploded view of an exemplary subassembly including a panel and the cable guide of FIG. 1A.
Figure 17:
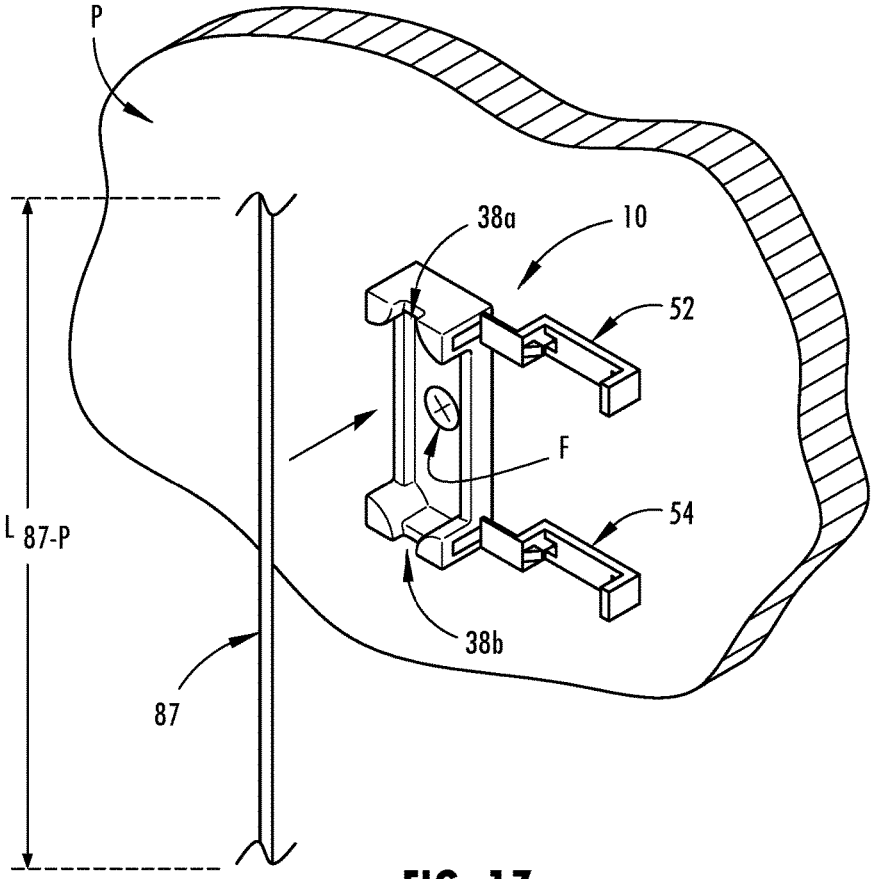
FIG. 17 is an assembled view of the exemplary subassembly of FIG. 16 and a portion of a length of a cable.

Referring to FIG. 1A, an attachment hardware bore 20 may extend through the thickness $T_{14}$ of the central body portion 14. A fastener F (see, e.g., FIGS. 16-17) may be arranged within the attachment hardware bore 20 for attaching the cable guide 10 to a panel P (see, e.g., FIGS. 16-17)

of, for example, the plurality of panels defining the dresser cabinet H. As seen in FIGS. 16-17, the fastener F may pass through the attachment hardware bore 20 and into a fastener bore B formed by a panel P (see, e.g., FIGS. 16-17) of, for example, the plurality of panels defining the dresser cabinet H for attaching the cable guide 10 to the panel P.

Figure 8A:
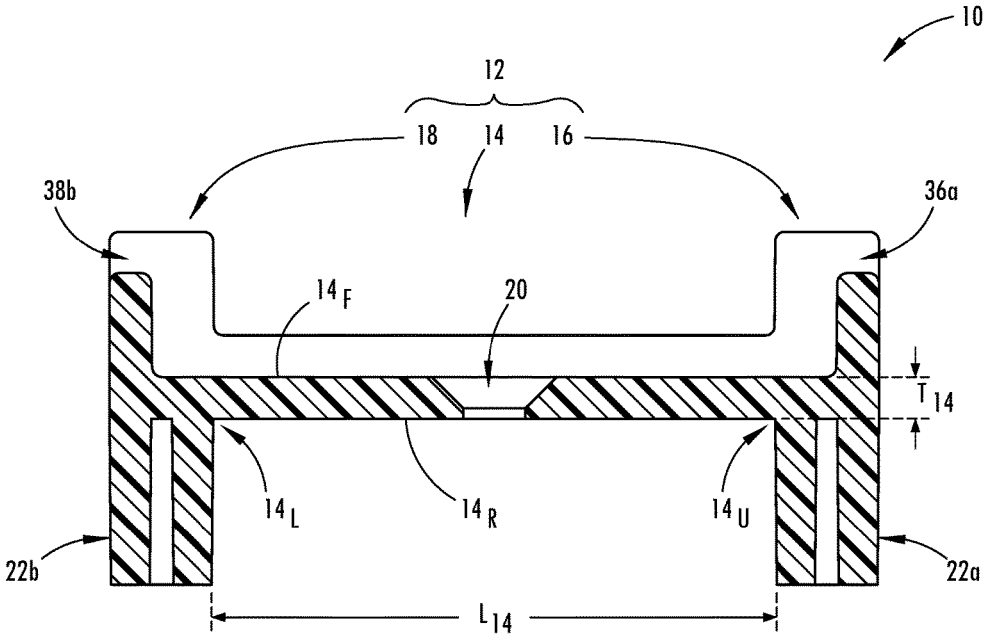
FIG. 8A is a cross-sectional view of the cable guide according to line 8A-8A of FIG. 2A.
Figure 8B:
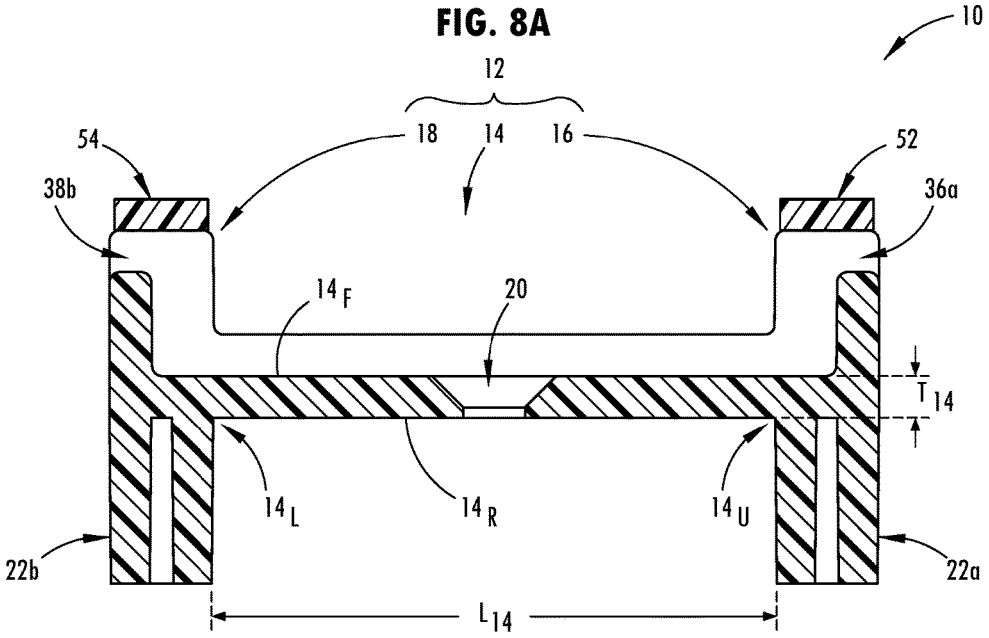
FIG. 8B is a cross-sectional view of the cable guide according to line 8B-8B of FIG. 2B.

As seen in FIG. 1A, one or more of a first attachment projection 22*a* and a second attachment projection 22*b* may extend away from the rear surface $\mathbf{14}_R$ of the central body portion 14. With reference to FIGS. 1A and 8A-8B, the first attachment projection 22*a* extends away from the rear surface $\mathbf{14}_R$ of the central body portion 14 near the upper end $\mathbf{14}_U$ of the central body portion 14. Referring to FIGS. 1A and 8A-8B, the second attachment projection 22*b* extends away from the rear surface $\mathbf{14}_R$ of the central body portion 14 near the lower end $\mathbf{14}_L$ of the central body portion 14. Each of the first attachment projection 22*a* and the second attachment projection 22*b* may be arranged within corresponding bores B (see, e.g., FIGS. 16-17) formed by a panel P (see, e.g., FIGS. 16-17) of, for example, the plurality of panels defining the dresser cabinet H for attaching the cable guide 10 to the panel P.

As seen in FIG. 1A, the upper body portion 16 generally extends away from the front surface $\mathbf{14}_F$ of the central body portion 14 and/or is near the upper end $\mathbf{14}_U$ of the central body portion 14. The lower body portion 18 generally extends away from the front surface $\mathbf{14}_F$ of the central body portion 14 and/or is near the lower end $\mathbf{14}_L$ of the central body portion 14.

Referring to FIG. 1A', the upper body portion 16 is generally defined by an end portion 24*a*. The end portion 24*a* includes: a central portion 26*a*; a first side portion 28*a*; and a second side portion 30*a*.

Figure 2A:
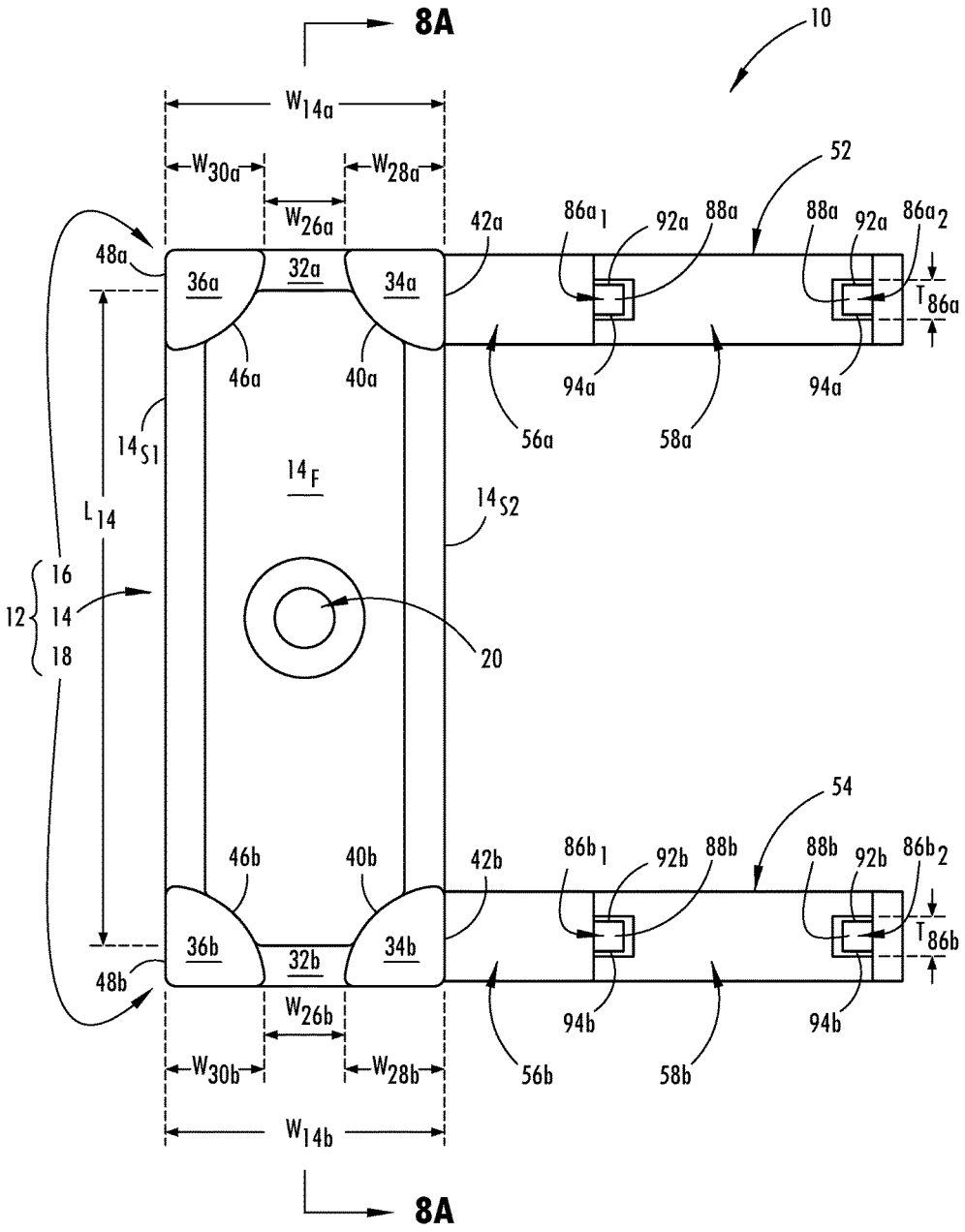
FIG. 2A is a front view of the cable guide of FIG. 1A.
Figure 2B:
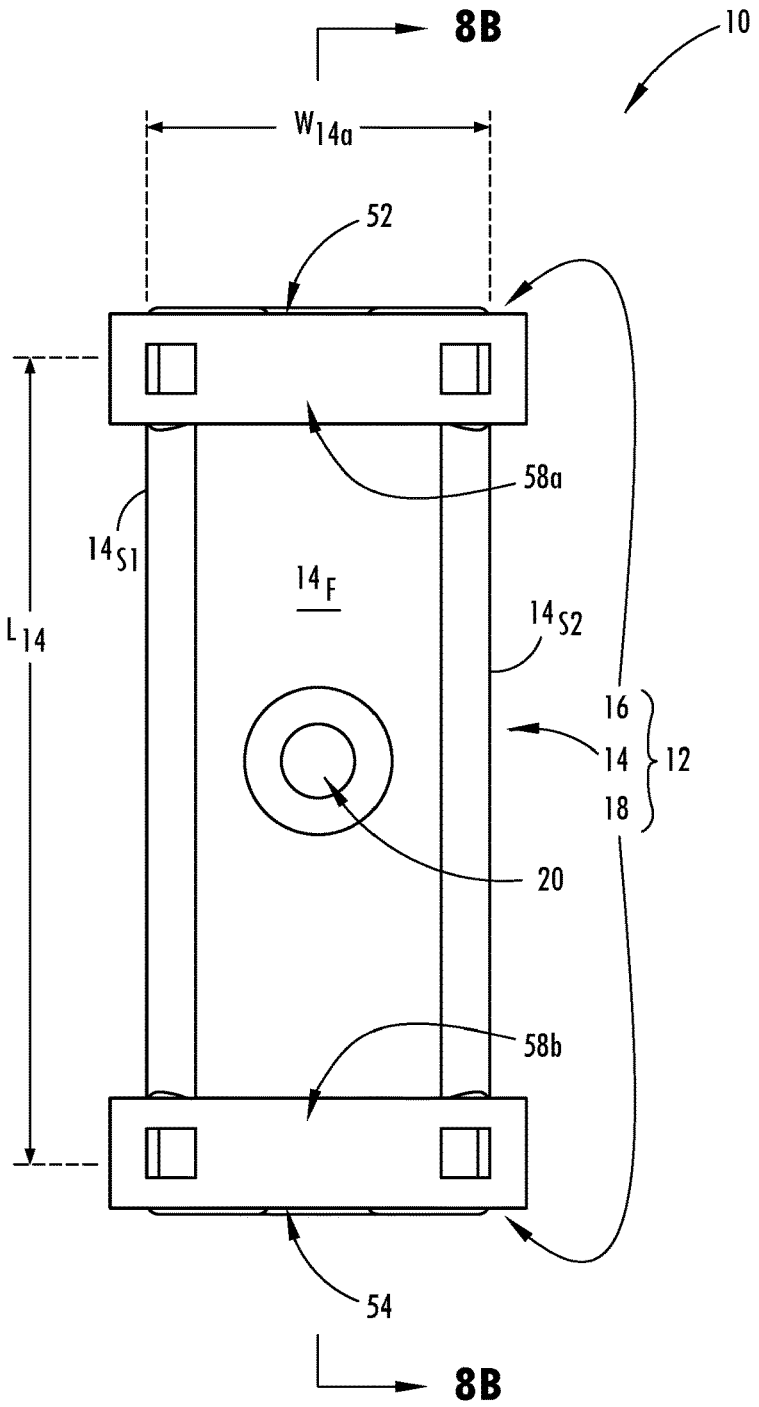
FIG. 2B is a front view of the cable guide of FIG. 1B.
Figure 3A:
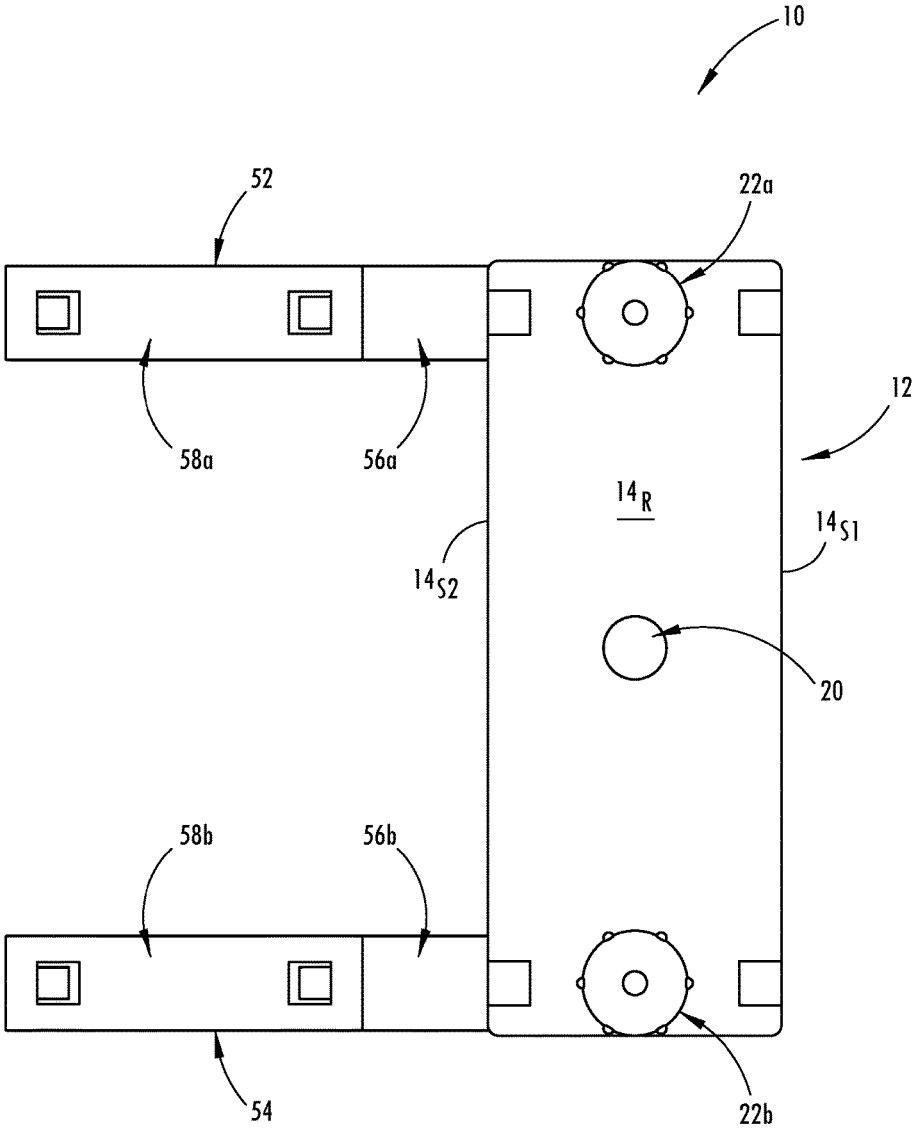
FIG. 3A is a rear view of the cable guide of FIG. 1A.
Figure 3B:
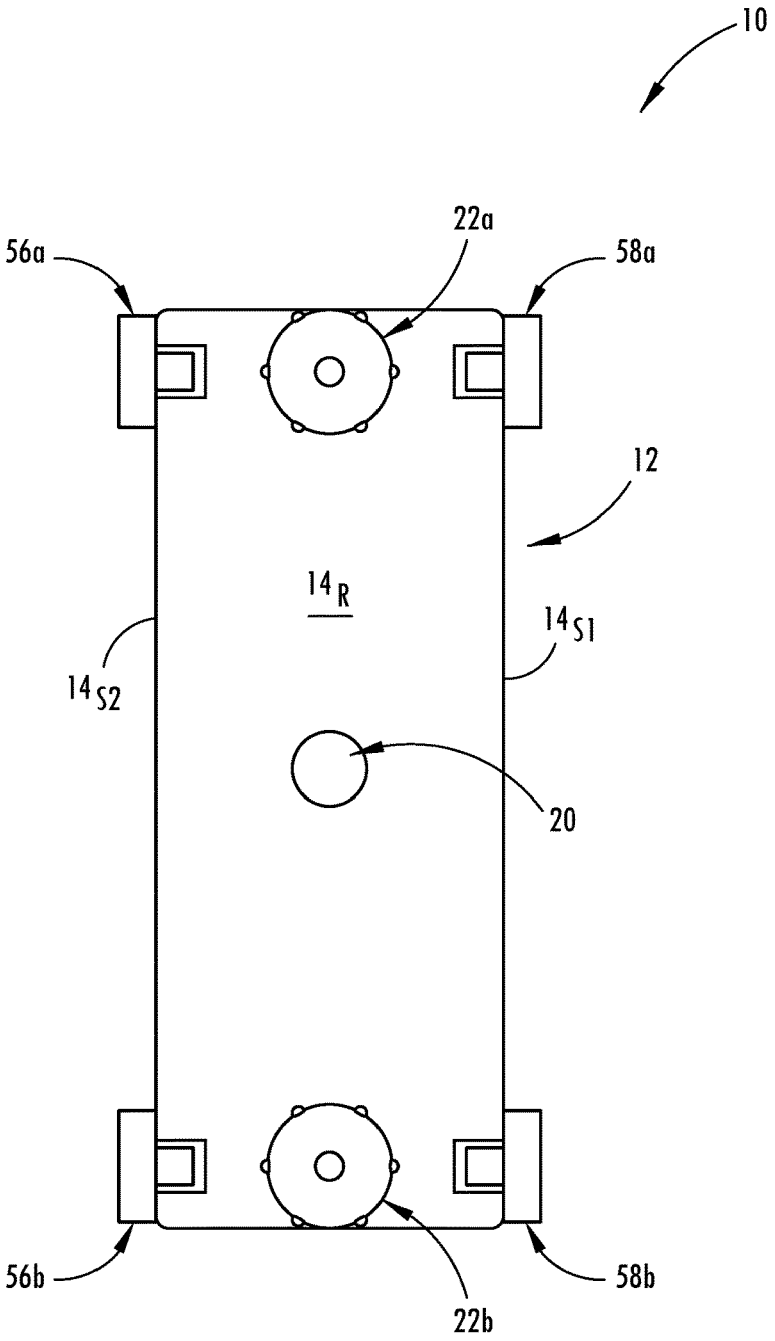
FIG. 3B is a rear view of the cable guide of FIG. 1B.

With reference to FIG. 2A, each of the central portion 26*a*, the first side portion 28*a* and the second side portion 30*a* may be defined by a width $W_{26a}$, $W_{28a}$, $W_{30a}$, respectively. Collectively, the widths $W_{26a}$, $W_{28a}$, $W_{30a}$ of the central portion 26*a*, the first side portion 28*a*, and the second side portion 30*a* may be substantially equal to the width $W_{14a}$, $W_{14b}$ of the central body portion 14.

Figure 7A:
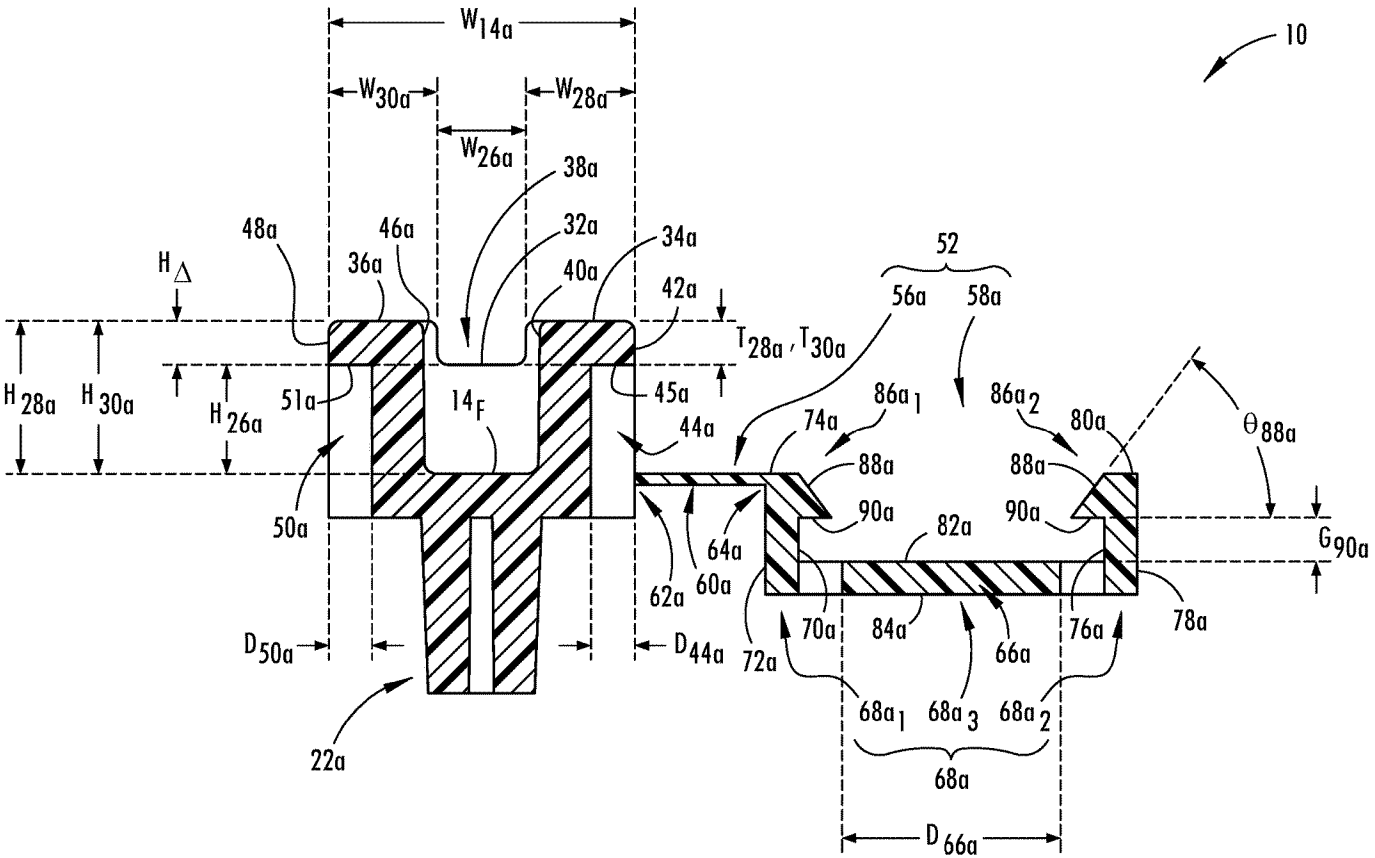
FIG. 7A is a cross-sectional view of the cable guide according to line 7A-7A of FIG. 1A.
Figure 7A:
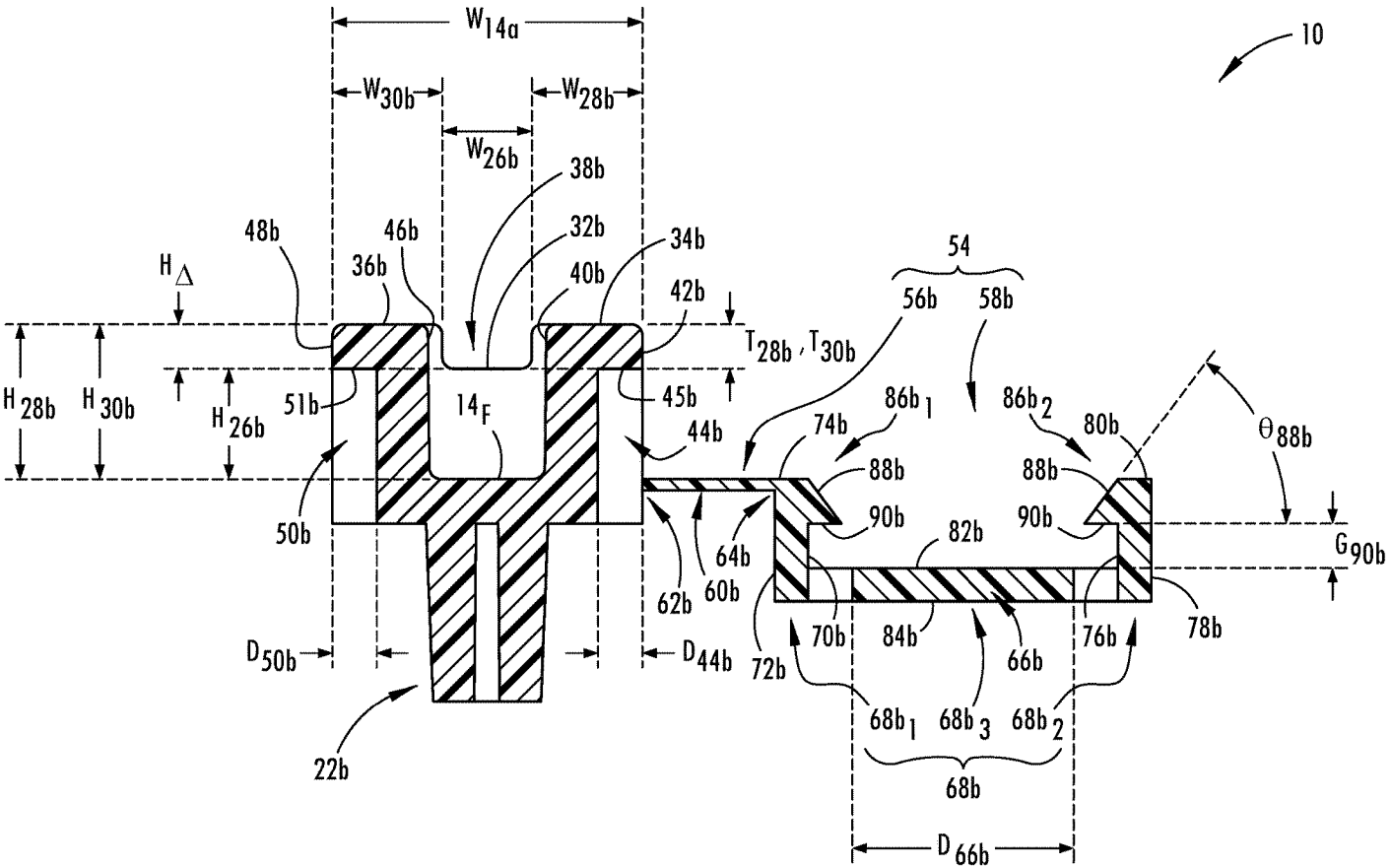
Figure 7B:
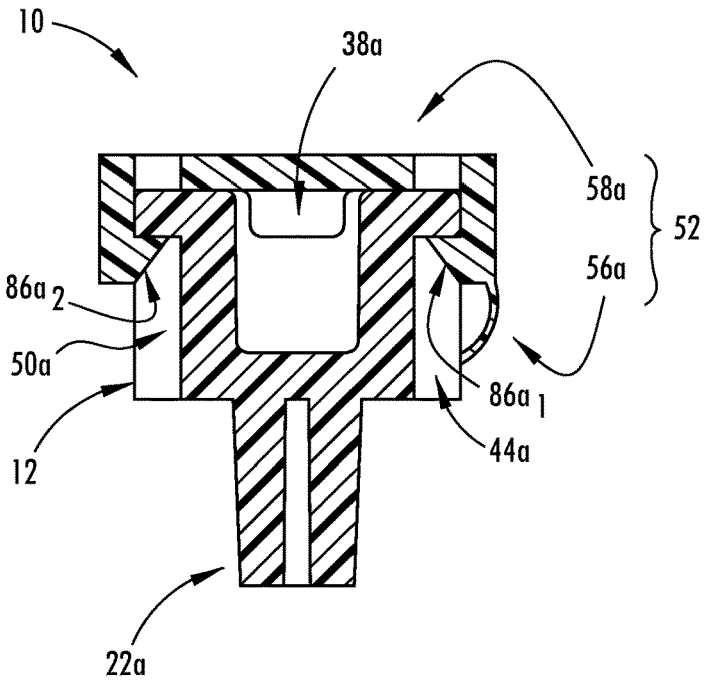
FIG. 7B is a cross-sectional view of the cable guide according to line 7B-7B of FIG. 1B.
Figure 7B:
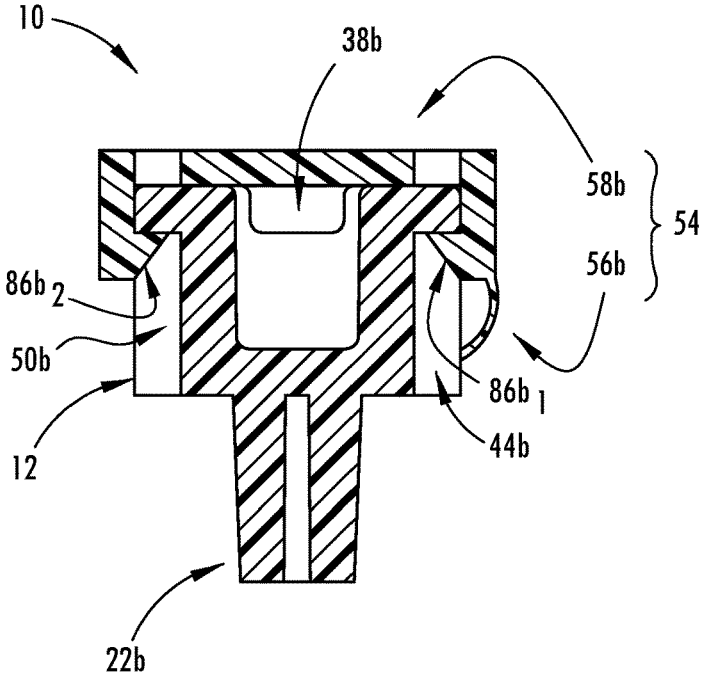

With reference to FIG. 7A, the central portion 26*a* extends away from the front surface $\mathbf{14}_F$ of the central body portion 14 at a first height $H_{26a}$; the first height $H_{26a}$ is bound by the front surface $\mathbf{14}_F$ of the central body portion 14 and an upper surface 32*a* of the central portion 26*a*. The first side portion 28*a* extends away from the front surface $\mathbf{14}_F$ of the central body portion 14 at a second height $H_{28a}$; the second height $H_{28a}$ is bound by the front surface $\mathbf{14}_F$ of the central body portion 14 and an upper surface 34*a* of the first side portion 28*a*. The second side portion 30*a* extends away from the front surface $\mathbf{14}_F$ of the central body portion 14 at a third height $H_{30a}$; the third height $H_{30a}$ is bound by the front surface $\mathbf{14}_F$ of the central body portion 14 and an upper surface 36*a* of the second side portion 30*a*.

With continued reference to FIG. 7A, in an example, the second height $H_{28a}$ and the third height $H_{30a}$ of, respectively, the first side portion 28*a* and the second side portion 30*a* may be substantially equal to one another, and, the first height $H_{26a}$ defined by the central portion 26*a* is less than the second height $H_{28a}$ and the third height $H_{30a}$; the height difference $H_\Delta$ of the first height $H_{26a}$ defined by the central portion 26*a* when compared to each of the second height $H_{28a}$ and the third height $H_{30a}$ results in the end portion 24*a* defining a cable-receiving passageway or slot 38*a*. The cable-receiving passageway or slot 38*a* is generally defined by the width of $W_{26a}$ the central portion 26*a* and the height difference $H_\Delta$ extending between the upper surface 32*a* of the central portion 26*a* and the upper surfaces 34*a*, 36*a* of each of the first side portion 28*a* and the second side portion 30*a*.

Referring to FIGS. 2A and 7A, in addition to the upper surface 34*a* of the first side portion 28*a*, the first side portion 28*a* may be further defined by: an inner surface 40*a*; and an outer surface 42*a*. The upper surface 34*a* may be defined by a substantially flat, planar or non-curved profile having a quarter-circle-shaped geometry. The inner surface 40*a* may be defined by an arcuate or curved profile. The outer surface 42*a* may be defined by a substantially flat, planar or non-curved profile having a rectangular-shaped geometry.

As seen in FIG. 7A, the substantially flat, planar or non-curved profile of the outer surface 42*a* may be interrupted by a barb-receiving recess 44*a*. The barb-receiving recess 44*a* may extend at a depth $D_{44a}$ from the outer surface 42*a* and into the first side portion 28*a*. The depth $D_{44a}$ is defined by a portion of the width $W_{28a}$ of the first side portion 28*a*.

Figure 5A:
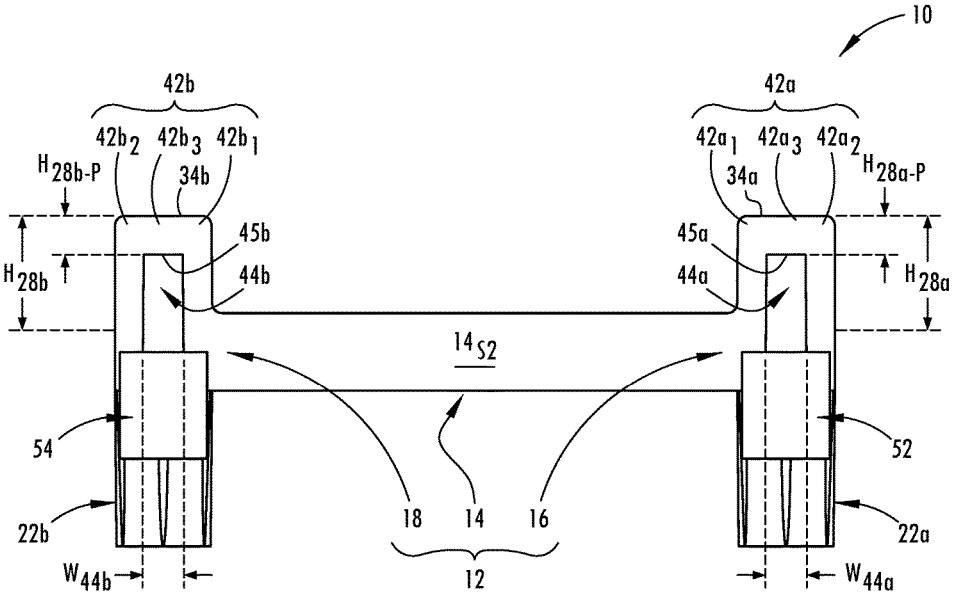
FIG. 5A is a second side view of the cable guide of FIG. 1A.
Figure 5B:
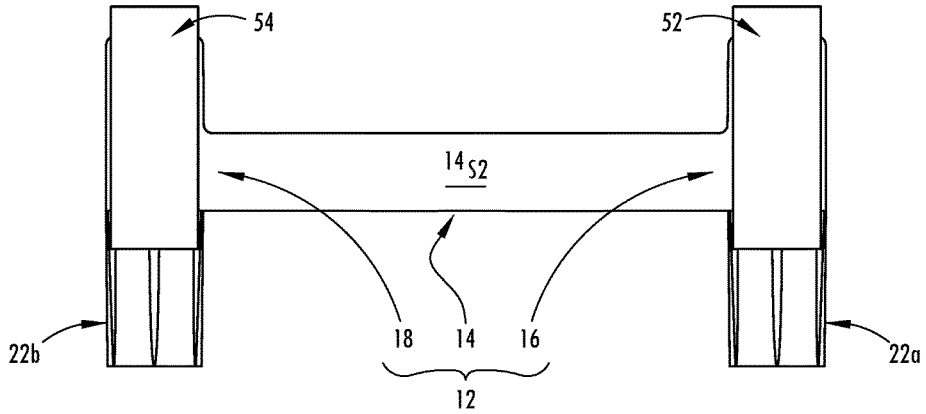
FIG. 5B is a second side view of the cable guide of FIG. 1B.
Figure 6A:
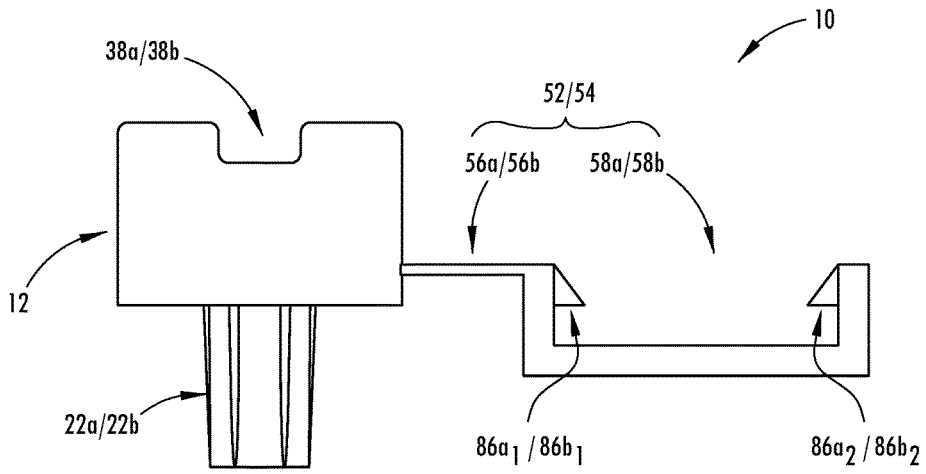
FIG. 6A is an end view of the cable guide of FIG. 1A.
Figure 6B:
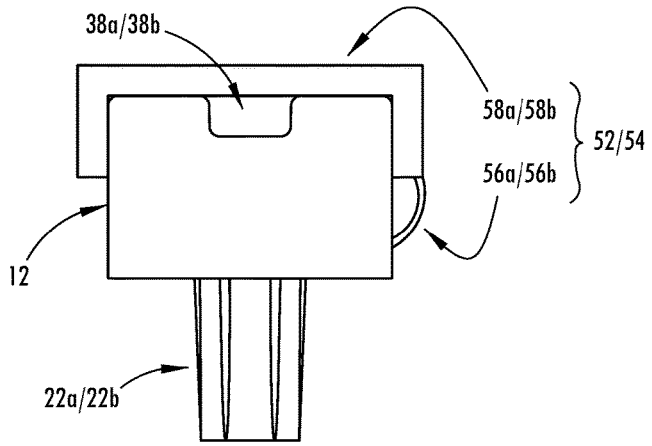
FIG. 6B is an end view of the cable guide of FIG. 1B.

As seen in FIG. 7A, the first side portion 28*a* may be further defined by a lower surface 45*a* that is arranged opposite and connected to the upper surface 34*a* of the first side portion 28*a* by way of the outer surface 42*a* of the first side portion 28*a*. The upper surface 34*a* and the lower surface 45*a* of the first side portion 28*a* define a thickness $T_{28a}$ of the first side portion 28*a*. As seen in FIG. 5A, the lower surface 45*a* may define a width $W_{44a}$ of the barb-receiving recess 44*a*.

Referring to FIG. 5A, the barb-receiving recess 44*a* results in the outer surface 42*a* of the first side portion 28*a* having: a first surface outer surface portion $\mathbf{42}a_1$ extending away from the upper surface 34*a* of the first side portion 28*a* and along the second height $H_{28a}$ defined by the first side portion 28*a*; a second outer surface portion $\mathbf{42}a_2$ extending away from the upper surface 34*a* of the first side portion 28*a* and along the second height $H_{28a}$ defined by the first side portion 28*a*; and a third outer surface portion $\mathbf{42}a_3$ extending away from the upper surface 34*a* of the first side portion 28*a* and along a portion $H_{28a\text{-}P}$ of the second height $H_{28a}$ defined by the first side portion 28*a*. The third outer surface portion $\mathbf{42}a_3$ connects the first surface outer surface portion $\mathbf{42}a_1$ to the second surface outer surface portion $\mathbf{42}a_2$.

With reference to FIGS. 2A and 7A, in addition to the upper surface 36*a* of the second side portion 30*a*, the second side portion 30*a* may be further defined by: an inner surface 46*a*; and an outer surface 48*a*. The upper surface 36*a* may be defined by a substantially flat, planar or non-curved profile having a quarter-circle-shaped geometry. The inner surface 46*a* may be defined by an arcuate or curved profile. The outer surface 48*a* may be defined by a substantially flat, planar or non-curved profile having a rectangular-shaped geometry.

As seen in FIG. 7A, the substantially flat, planar or non-curved profile of the outer surface 48*a* may be interrupted by a barb-receiving recess 50*a*. The barb-receiving recess 50*a* may extend at a depth $D_{50a}$ from the outer surface 48*a* and into the second side portion 30*a*. The depth $D_{50a}$ is defined by a portion of the width $W_{30a}$ of the second side portion 30*a*.

Figure 4A:
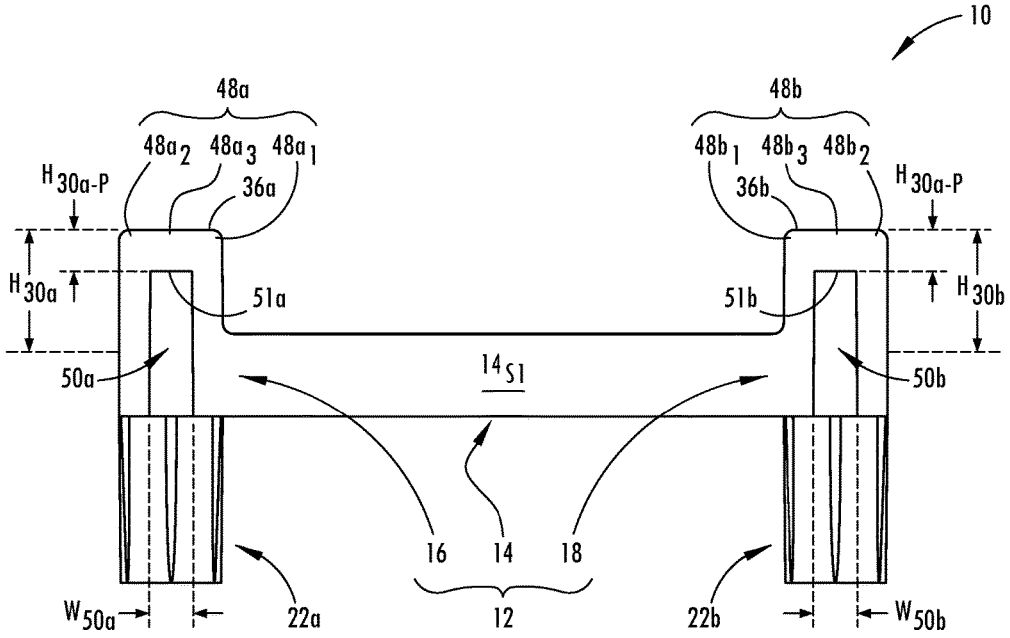
FIG. 4A is a first side view of the cable guide of FIG. 1A.
Figure 4B:
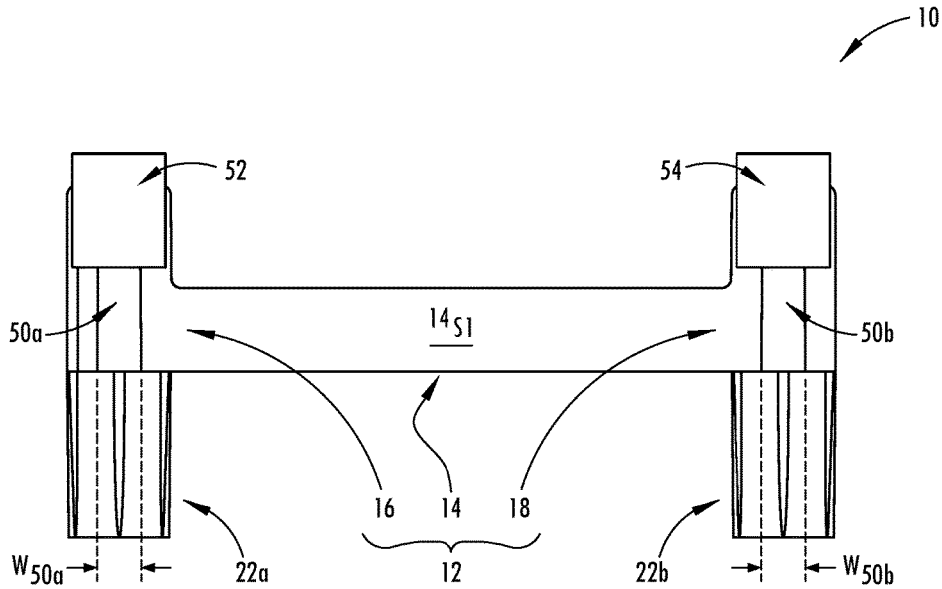
FIG. 4B is a first side view of the cable guide of FIG. 1B.

As seen in FIG. 7A, the second side portion 30*a* may be further defined by a lower surface 51*a* that is arranged opposite and connected to the upper surface 36*a* of the second side portion 30*a* by way of the outer surface 48*a* of the second side portion 30*a*. The upper surface 36*a* and the lower surface 51*a* of the second side portion 30*a* define a thickness $T_{30a}$ of the second side portion 30*a*. As seen in FIG. 4A, the lower surface 51*a* may define a width $W_{50a}$ of the barb-receiving recess 50*a*.

With reference to FIG. 4A, the barb-receiving recess 50*a* results in the outer surface 48*a* of the second side portion 30*a* having: a first surface outer surface portion 48*a*$_1$ extending away from the upper surface 36*a* of the second side portion 30*a* and along the third height $H_{30a}$ defined by the second side portion 30*a*; a second outer surface portion 48*a*$_2$ extending away from the upper surface 36*a* of the second side portion 30*a* and along the third height $H_{30a}$ defined by the second side portion 30; and a third outer surface portion 48*a*$_3$ extending away from the upper surface 36*a* of the second side portion 30*a* and along a portion $H_{30a\text{-}P}$ of the third height $H_{30a}$ defined by the second side portion 30*a*. The third outer surface portion 48*a*$_3$ connects the first surface outer surface portion 48*a*$_1$ to the second surface outer surface portion 48*a*$_2$.

Referring to FIG. 1A", the lower body portion 18 is generally defined by an end portion 24*b*. The end portion 24*b* includes: a central portion 26*b*; a first side portion 28*b*; and a second side portion 30*b*.

With reference to FIG. 2A, each of the central portion 26*b*, the first side portion 28*b* and the second side portion 30*b* may be defined by a width $W_{26b}$, $W_{28b}$, $W_{30b}$, respectively. Collectively, the widths $W_{26b}$, $W_{28b}$, $W_{30b}$ of the central portion 26*b*, the first side portion 28*b*, and the second side portion 30*b* may be substantially equal to the width $W_{14a}$, $W_{14b}$ of the central body portion 14.

With reference to FIG. 7A', the central portion 26*b* extends away from the front surface 14$_F$ of the central body portion 14 at a first height $H_{26b}$; the first height $H_{26b}$ is bound by the front surface 14$_F$ of the central body portion 14 and an upper surface 32*b* of the central portion 26*b*. The first side portion 28*b* extends away from the front surface 14$_F$ of the central body portion 14 at a second height $H_{28b}$; the second height $H_{28b}$ is bound by the front surface 14$_F$ of the central body portion 14 and an upper surface 34*b* of the first side portion 28*b*. The second side portion 30*b* extends away from the front surface 14$_F$ of the central body portion 14 at a third height $H_{30b}$; the third height $H_{30b}$ is bound by the front surface 14$_F$ of the central body portion 14 and an upper surface 36*b* of the second side portion 30*b*.

In an example, the second height $H_{28b}$ and the third height $H_{30b}$ of, respectively, the first side portion 28*b* and the second side portion 30*b* may be substantially equal to one another, and, the first height $H_{26b}$ defined by the central portion 26*b* is less than the second height $H_{28b}$ and the third height $H_{30b}$; the height difference $H_\Delta$ of the first height $H_{26b}$ defined by the central portion 26*b* when compared to each of the second height $H_{28b}$ and the third height $H_{30b}$ results in the end portion 24*b* defining a cable-receiving passageway or slot 38*b*. The cable-receiving passageway or slot 38*b* is generally defined by the width $W_{26b}$ of the central portion 26*b* and the height difference $H_\Delta$ extending between the upper surface 32*b* of the central portion 26*b* and the upper surfaces 34*b*, 36*b* of each of the first side portion 28*b* and the second side portion 30*b*.

Referring to FIGS. 2A and 7A', in addition to the upper surface 34*b* of the first side portion 28*b*, the first side portion 28*b* may be further defined by: an inner surface 40*b*; and an outer surface 42*b*. The upper surface 34*b* may be defined by a substantially flat, planar or non-curved profile having a quarter-circle-shaped geometry. The inner surface 40*b* may be defined by an arcuate or curved profile. The outer surface 42*b* may be defined by a substantially flat, planar or non-curved profile having a rectangular-shaped geometry.

As seen in FIG. 7A', the substantially flat, planar or non-curved profile of the outer surface 42*b* may be interrupted by a barb-receiving recess 44*b*. The barb-receiving recess 44*b* may extend at a depth $D_{44b}$ from the outer surface 42*b* and into the first side portion 28*b*. The depth $D_{44b}$ is defined by a portion of the width $W_{28b}$ of the first side portion 28*b*.

As seen in FIG. 7A', the first side portion 28*b* may be further defined by a lower surface 45*b* that is arranged opposite and connected to the upper surface 34*b* of the first side portion 28*b* by way of the outer surface 42*b* of the first side portion 28*b*. The upper surface 34*b* and the lower surface 45*b* of the first side portion 28*b* define a thickness $T_{28b}$ of the first side portion 28*b*. As seen in FIG. 5A, the lower surface 45*b* may define a width $W_{44b}$ of the barb-receiving recess 44*b*.

The barb-receiving recess 44*b* results in the outer surface 42*b* of the first side portion 28*b* having: a first surface outer surface portion 42*b*$_1$ extending away from the upper surface 34*b* of the first side portion 28*b* and along the second height $H_{28b}$ defined by the first side portion 28*b*; a second outer surface portion 42*b*$_2$ extending away from the upper surface 34*b* of the first side portion 28*b* and along the second height $H_{28b}$ defined by the first side portion 28*b*; and a third outer surface portion 42*b*$_3$ extending away from the upper surface 34*b* of the first side portion 28*b* and along a portion $H_{28b\text{-}P}$ of the second height $H_{28b}$ defined by the first side portion 28*b*. The third outer surface portion 42*b*$_3$ connects the first surface outer surface portion 42*b*$_1$ to the second surface outer surface portion 42*b*$_2$.

In addition to the upper surface 36*b* of the second side portion 30*b*, the second side portion 30*b* may be further defined by: an inner surface 46*b*; and an outer surface 48*b*. The upper surface 36*b* may be defined by a substantially flat, planar or non-curved profile having a quarter-circle-shaped geometry. The inner surface 46*b* may be defined by an arcuate or curved profile. The outer surface 48*b* may be defined by a substantially flat, planar or non-curved profile having a rectangular-shaped geometry.

The substantially flat, planar or non-curved profile of the outer surface 48*b* may be interrupted by a barb-receiving recess 50*b*. The barb-receiving recess 50*b* may extend at a depth $D_{50b}$ from the outer surface 48*b* and into the second side portion 30*b*. The depth $D_{50b}$ is defined by a portion of the width $W_{30b}$ of the second side portion 30*b*.

The second side portion 30*b* may be further defined by a lower surface 51*b* that is arranged opposite and connected to the upper surface 36*b* of the second side portion 30*b* by way of the outer surface 48*b* of the second side portion 30*b*. The upper surface 36*b* and the lower surface Sib of the second side portion 30*b* define a thickness $T_{30b}$ of the second side portion 30*b*. As seen in FIG. 4A, the lower surface 51*b* may define a width $W_{50b}$ of the barb-receiving recess 50*b*.

Referring to FIG. 4A, the barb-receiving recess 50*b* results in the outer surface 48*b* of the second side portion 30*b* having: a first surface outer surface portion 48*b*$_1$ extending away from the upper surface 36*b* of the second side portion 30*b* and along the third height $H_{30b}$ defined by the second side portion 30*b*; a second outer surface portion 48*b*$_2$ extending away from the upper surface 36*b* of the second side portion 30*b* and along the third height $H_{30b}$ defined by the second side portion 30; and a third outer surface portion 48*b*$_3$ extending away from the upper surface 36*b* of the second side portion 30*b* and along a portion $H_{30b\text{-}P}$ of the third height $H_{30b}$ defined by the second side portion 30*b*. The third outer surface portion 48$b_3$ connects the first surface outer surface portion 48$b_1$ to the second surface outer surface portion 48$b_2$.

Referring to FIG. 1A, the cable guide 10 also includes an upper cable-retaining body 52 and a lower cable-retaining body 54. The upper cable-retaining body 52 is integral with and extends away from the body 12; in an example, the upper cable-retaining body 52 is integral with and extends away from the outer surface 42*a* of the first side portion 28*a* of the upper body portion 16 of the body 12. The lower cable-retaining body 54 is integral with and extends away from the body 12; in an example, the lower cable-retaining body 54 is integral with and extends away from the outer surface 42*b* of the first side portion 28*b* of the lower body portion 18 of the body 12.

Referring to FIG. 7A, the upper cable-retaining body 52 includes a tether portion 56*a*. The upper cable-retaining body 52 also includes a clamping portion 58*a*.

The tether portion 56*a* includes a flexible body 60*a*. The flexible body 60*a* is generally defined by a first end 62*a* and a second end 64*a*.

The first end 62*a* of the tether portion 56*a* is integral with and extends away from the outer surface 42*a* of the first side portion 28*a* of the upper body portion 16. In an example, the first end 62*a* of the tether portion 56*a* is integral with and extends from the first surface outer surface portion 42$a_1$ and the second surface outer surface portion 42$a_2$ while extending across the barb-receiving recess 44*a*.

The clamping portion 58*a* may be generally defined by a C-shaped body 66*a*. The C-shaped body 66*a* includes a proximal body portion 68$a_1$, a distal body portion 68$a_2$ and an intermediate body portion 68$a_3$ connecting the proximal body portion 68$a_1$ to the distal body portion 68$a_2$.

The proximal body portion 68$a_1$ is defined by an inner surface 70*a*, an outer surface 72*a* and an intermediate surface 74*a* joining the inner surface 70*a* to the outer surface 72*a*. The distal body portion 68$a_2$ is defined by an inner surface 76*a*, an outer surface 78*a* and an intermediate surface 80*a* joining the inner surface 76*a* to the outer surface 78*a*. The intermediate body portion 68$a_3$ is defined by an inner surface 82*a* and an outer surface 84*a*.

The second end 64*a* of the tether portion 56*a* is integral with and extends away from the outer surface 72*a* of the proximal body portion 68$a_1$ of the C-shaped body 66*a* of the clamping portion 58*a*. In an example, the second end 64*a* of the tether portion 56*a* is integral with and extends from the outer surface 72*a* of the proximal body portion 68$a_1$ of the C-shaped body 66*a* of the clamping portion 58*a* near the intermediate surface 74*a* of the proximal body portion 68$a_1$ of the C-shaped body 66*a* of the clamping portion 58*a*.

The inner surface 70*a* of the proximal body portion 68$a_1$ is connected to the inner surface 82*a* of the intermediate body portion 68$a_3$. The outer surface 72*a* of the proximal body portion 68$a_1$ is connected to the outer surface 84*a* of the intermediate body portion 68$a_3$. The inner surface 76*a* of the distal body portion 68$a_2$ is connected to the inner surface 82*a* of the intermediate body portion 68$a_3$. The outer surface 78*a* of the distal body portion 68$a_2$ is connected to the outer surface 84*a* of the intermediate body portion 68$a_3$.

With continued reference to FIG. 7A, the inner surface 70*a* of the proximal body portion 68$a_1$ is arranged opposite the inner surface 76*a* of the distal body portion 68$a_2$. The inner surface 70*a* of the proximal body portion 68$a_1$ and the inner surface 76*a* of the distal body portion 68$a_2$ are spaced apart by a distance $D_{66a}$; the distance $D_{66a}$ extending between the inner surface 70*a* of the proximal body portion 68$a_1$ and the inner surface 76*a* of the distal body portion 68$a_2$ is approximately equal to but slightly greater than width $W_{14a}$, $W_{14b}$ of the central body portion 14.

With reference to FIGS. 1A and 7A, the clamping portion 58*a* may be further defined by: a first barb 86$a_1$ extending from the C-shaped body 66*a*; and a second barb 86$a_2$ extending from the C-shaped body 66*a*. In an example, the first barb 86$a_1$ extends from the inner surface 70*a* of the proximal body portion 68$a_1$ of the C-shaped body 66*a* near the intermediate surface 74*a* of the proximal body portion 68$a_1$ of the C-shaped body 66*a*. In an example, the second barb 86$a_2$ extends from the inner surface 76*a* of the distal body portion 68$a_2$ of the C-shaped body 66*a* near the intermediate surface 80*a* of the distal body portion 68$a_2$ of the C-shaped body 66*a*.

Both of the first barb 86$a_1$ and the second barb 86$a_2$ are defined by a ramp surface 88*a*, a shoulder surface 90*a*, a first side surface 92*a* (see, e.g., FIG. 2A) and a second side surface 94*a* (see, e.g., FIG. 2A). Furthermore, as seen in FIG. 2A, both of the first barb 86$a_1$ and the second barb 86$a_2$ are defined by a thickness $T_{86a}$ extending between the first side surface 92*a* and the second side surface 94*a*. The thickness $T_{86a}$ extending between the first side surface 92*a* and the second side surface 94*a* of the first barb 86$a_1$ is approximately equal to but slightly less than the width $W_{44a}$ of the barb-receiving recess 44*a* of the first side portion 28*a* of the end portion 24*a* of the upper body portion 16. The thickness $T_{86a}$ extending between the first side surface 92*a* and the second side surface 94*a* of the second barb 86$a_2$ is approximately equal to but slightly less than the width $W_{50a}$ of the barb-receiving recess 50*a* of the second side portion 30*a* of the end portion 24*a* of the upper body portion 16.

As seen in FIG. 7A, the ramp surface 88*a* of the first barb 86$a_1$ is arranged at an angle $\theta_{88a}$ relative the inner surface 70*a* of the proximal body portion 68$a_1$. The ramp surface 88*a* of the second barb 86$a_2$ is arranged at an angle $\theta_{88a}$ relative the inner surface 76*a* of the distal body portion 68$a_2$. In an example the angle $\theta_{88a}$ of the ramp surface 88*a* of each of the first barb 86$a_1$ and the second barb 86$a_2$ is approximately equal to 45°.

The shoulder surface 90*a* of each of the first barb 86$a_1$ and the second barb 86$a_2$ is arranged opposite the inner surface 82*a* of the intermediate body portion 68$a_3$ of the C-shaped body 66*a* and spaced apart therefrom to define a spacing or gap $G_{90a}$. The spacing or gap $G_{90a}$ formed by the first barb 86$a_1$ is approximately equal to but slightly greater than the thickness $T_{28a}$ of the first side portion 28*a* extending between the upper surface 34*a* and the lower surface 45*a* of the first side portion 28*a* of the end portion 24*a* of the upper body portion 16. The spacing or gap $G_{90a}$ formed by the second barb 86$a_2$ is approximately equal to but slightly greater than the thickness $T_{30a}$ of the second side portion 30*a* extending between the upper surface 36*a* and the lower surface 51*a* of the second side portion 30*a* of the end portion 24*a* of the upper body portion 16.

Referring to FIG. 7A', the lower cable-retaining body 54 includes a tether portion 56*b*. The lower cable-retaining body 54 also includes a clamping portion 58*b*.

The tether portion 56*b* includes a flexible body 60*b*. The flexible body 60*b* is generally defined by a first end 62*b* and a second end 64*b*.

The first end 62*b* of the tether portion 56*b* is integral with and extends away from the outer surface 42*b* of the first side portion 28*b* of the lower body portion 18. In an example, the first end 62*b* of the tether portion 56*b* is integral with and extends from the first surface outer surface portion 42$b_1$ and the second surface outer surface portion 42$b_2$ while extending across the barb-receiving recess 44*b*.

The clamping portion 58*b* may be generally defined by a C-shaped body 66*b*. The C-shaped body 66*b* includes a proximal body portion 68*b*$_1$, a distal body portion 68*b*$_2$ and an intermediate body portion 68*b*$_3$ connecting the proximal body portion 68*b*$_1$ to the distal body portion 68*b*$_2$.

The proximal body portion 68*b*$_1$ is defined by an inner surface 70*b*, an outer surface 72*b* and an intermediate surface 74*b* joining the inner surface 70*b* to the outer surface 72*b*. The distal body portion 68*b*$_2$ is defined by an inner surface 76*b*, an outer surface 78*b* and an intermediate surface 80*b* joining the inner surface 76*b* to the outer surface 78*b*. The intermediate body portion 68*b*$_3$ is defined by an inner surface 82*b* and an outer surface 84*b*.

The second end 64*b* of the tether portion 56*b* is integral with and extends away from the outer surface 72*b* of the proximal body portion 68*b*$_1$ of the C-shaped body 66*b* of the clamping portion 58*b*. In an example, the second end 64*b* of the tether portion 56*b* is integral with and extends from the outer surface 72*b* of the proximal body portion 68*b*$_1$ of the C-shaped body 66*b* of the clamping portion 58*b* near the intermediate surface 74*b* of the proximal body portion 68*b*$_1$ of the C-shaped body 66*b* of the clamping portion 58*b*.

The inner surface 70*b* of the proximal body portion 68*b*$_1$ is connected to the inner surface 82*b* of the intermediate body portion 68*b*$_3$. The outer surface 72*b* of the proximal body portion 68*b*$_1$ is connected to the outer surface 84*b* of the intermediate body portion 68*b*$_3$. The inner surface 76*b* of the distal body portion 68*b*$_2$ is connected to the inner surface 82*b* of the intermediate body portion 68*b*$_3$. The outer surface 78*b* of the distal body portion 68*b*$_2$ is connected to the outer surface 84*b* of the intermediate body portion 68*b*$_3$.

The inner surface 70*b* of the proximal body portion 68*b*$_1$ is arranged opposite the inner surface 76*b* of the distal body portion 68*b*$_2$. The inner surface 70*b* of the proximal body portion 68*b*$_1$ and the inner surface 76*b* of the distal body portion 68*b*$_2$ are spaced apart by a distance $D_{66b}$; the distance $D_{66b}$ extending between the inner surface 70*b* of the proximal body portion 68*b*$_1$ and the inner surface 76*b* of the distal body portion 68*b*$_2$ is approximately equal to but slightly greater than width $W_{14a}$, $W_{14b}$ of the central body portion 14.

The clamping portion 58*b* may be further defined by: a first barb 86*b*$_1$ extending from the C-shaped body 66*b*; and a second barb 86*b*$_2$ extending from the C-shaped body 66*b*. In an example, the first barb 86*b*, extends from the inner surface 70*b* of the proximal body portion 68*b*$_1$ of the C-shaped body 66*b* near the intermediate surface 74*b* of the proximal body portion 68*b*$_1$ of the C-shaped body 66*b*. In an example, the second barb 86*b*$_2$ extends from the inner surface 76*b* of the distal body portion 68*b*$_2$ of the C-shaped body 66*b* near the intermediate surface 80*b* of the distal body portion 68*b*$_2$ of the C-shaped body 66*b*.

Both of the first barb 86*b*$_1$ and the second barb 86*b*$_2$ are defined by a ramp surface 88*b*, a shoulder surface 90*b*, a first side surface 92*b* (see, e.g., FIG. 2A) and a second side surface 94*b* (see, e.g., FIG. 2A). Furthermore, as seen in FIG. 2A, both of the first barb 86*b*$_1$ and the second barb 86*b*$_2$ are defined by a thickness $T_{86b}$ extending between the first side surface 92*b* and the second side surface 94*b*. The thickness $T_{86b}$ extending between the first side surface 92*b* and the second side surface 94*b* of the first barb 86*b*, is approximately equal to but slightly less than the width $W_{44b}$ of the barb-receiving recess 44*b* of the first side portion 28*b* of the end portion 24*b* of the lower body portion 18. The thickness $T_{86b}$ extending between the first side surface 92*b* and the second side surface 94*b* of the second barb 86*b*$_2$ is approximately equal to but slightly less than the width $W_{50b}$ of the barb-receiving recess 50*b* of the second side portion 30*b* of the end portion 24*b* of the lower body portion 18.

As seen in FIG. 7A', the ramp surface 88*b* of the first barb 86*b*$_1$ is arranged at an angle $\theta_{88b}$ relative the inner surface 70*b* of the proximal body portion 68*b*$_1$. The ramp surface 88*b* of the second barb 86*b*$_2$ is arranged at an angle $\theta_{88b}$ relative the inner surface 76*b* of the distal body portion 68*b*$_2$. In an example the angle $\theta_{88b}$ of the ramp surface 88*b* of each of the first barb 86*b*$_1$ and the second barb 86*b*$_2$ is approximately equal to 45°.

The shoulder surface 90*b* of each of the first barb 86*b*$_1$ and the second barb 86*b*$_2$ is arranged opposite the inner surface 82*b* of the intermediate body portion 68*b*$_3$ of the C-shaped body 66*b* and spaced apart therefrom to define a spacing or gap $G_{90b}$. The spacing or gap $G_{90b}$ formed by the first barb 86*b*$_1$ is approximately equal to but slightly greater than the thickness $T_{28b}$ of the first side portion 28*b* extending between the upper surface 34*b* and the lower surface 45*b* of the first side portion 28*b* of the end portion 24*b* of the lower body portion 18. The spacing or gap $G_{90b}$ formed by the second barb 86*b*$_2$ is approximately equal to but slightly greater than the thickness $T_{30b}$ of the second side portion 30*b* extending between the upper surface 36*b* and the lower surface 51*b* of the second side portion 30*b* of the end portion 24*b* of the lower body portion 18.

Referring to FIGS. 1A, 2A, 3A, 4A, 5A, 6A, 7A and 8A, the cable guide 10 is shown arranged in a first orientation. The first orientation may be alternatively referred to as an "open orientation" whereby both of the upper cable-retaining body 52 and the lower cable-retaining body 54 that integrally-extend away from the body 12 are not removably-secured to the body 12. Conversely, as seen in 1B, 2B, 3B, 4B, 5B, 6B, 7B and 8B, the cable guide 10 is shown arranged in a second orientation. The second orientation may be alternatively referred to as a "closed orientation" whereby both of the upper cable-retaining body 52 and the lower cable-retaining body 54 that integrally-extend away from the body 12 are removably-secured to the body 12. The purpose of removably-securing the upper cable-retaining body 52 and the lower cable-retaining body 54 to the body 12 is described in greater detail in the following disclosure at FIGS. 17-19.

Figure 9:
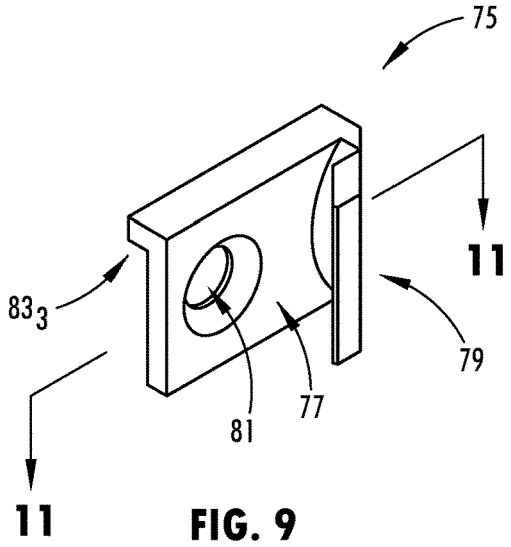
FIG. 9 is a perspective view of an exemplary cable engagement device.
Figure 10:
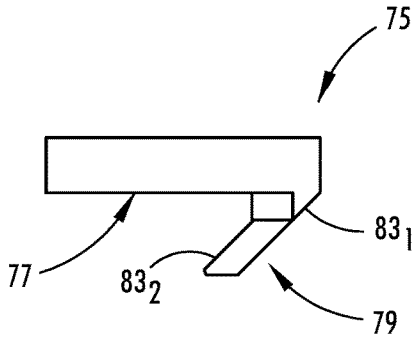
FIG. 10 is a side view of the cable engagement device of FIG. 9.
Figure 11:
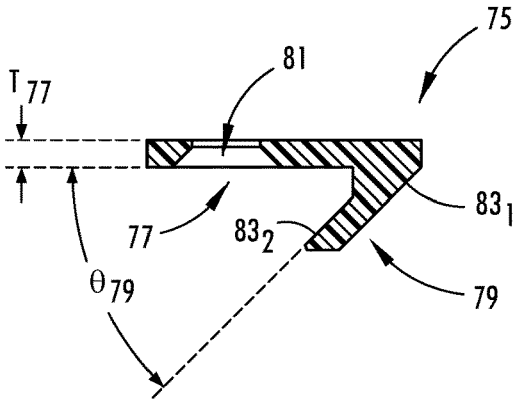
FIG. 11 is a cross-section view of the cable engagement device according to line 11-11 of FIG. 9.

Referring to FIGS. 9-11, an exemplary cable engagement device 75 is now described. The cable engagement device 75 includes a base portion 77 and a hook portion 79.

The base portion 77 is defined by a thickness $T_{77}$ (see, e.g., FIG. 11). An attachment hardware bore 81 may extend through the thickness $T_{77}$ of the base portion 77.

The hook portion 79 is arranged at an angle $\theta_{79}$ relative the base portion 77. The angle $\theta_{79}$ may be approximately equal to 45°. With reference to FIGS. 10-11, the hook portion 79 further includes a ramp surface 83$_1$ and a cable-pulling surface 83$_2$. With reference to FIG. 9, the base portion 77 may also define a locating ledge 83$_3$.

Referring to FIGS. 12-13, an exemplary cable tensioning device 85 including the cable 87 is now described. The cable tensioning device 85 includes a casing 89 having a base portion 91 and cable-stowing housing 93. The base portion 91 is a substantially planar body defined by a thickness $T_{91}$ (see, e.g., FIG. 12). One or more attachment hardware bores 95 may extend through the thickness $T_{91}$ of the base portion 91.

As seen in FIG. 13, a cable tensioner 97 (e.g. a spring) may be disposed within the cable-stowing housing 93 for biasing the cable 87 within the cable-stowing housing 93 in a wound orientation. Accordingly, when a force that overcomes the bias imparted by the cable tensioner 97 is applied to the cable 87, a length of the cable 87 is drawn out of the cable-stowing housing 93. After the force is no longer applied to the cable, the bias imparted by the cable tensioner 97 reels the length of the cable 87 back into the cable-stowing housing 93. In order to access the cable 87 for imparting the bias-overcoming force to the cable 87 as described above, at least a portion of the length of the cable 87 extending from a distal end $\mathbf{87}_D$ of the cable 87 remains outside of the cable-stowing housing 93.

Referring to FIGS. 14-19, a method of interfacing portions (e.g., the cable tensioning device 85 including the cable 87 and at least one cable guide 10) of the implement interlock system 100 with one another is now described. Although a portion of a panel P of, for example, a plurality of panels defining an article of furniture such as a dresser cabinet H is also shown in FIGS. 14-19, the panel P is not required for joining or interfacing portions of the implement interlock system 100 as shown and described at FIGS. 14-19. Therefore, the panel P may be considered to be an environmental or optional component and should not be construed as a feature or structure of the implement interlock system 100.

Figure 14:
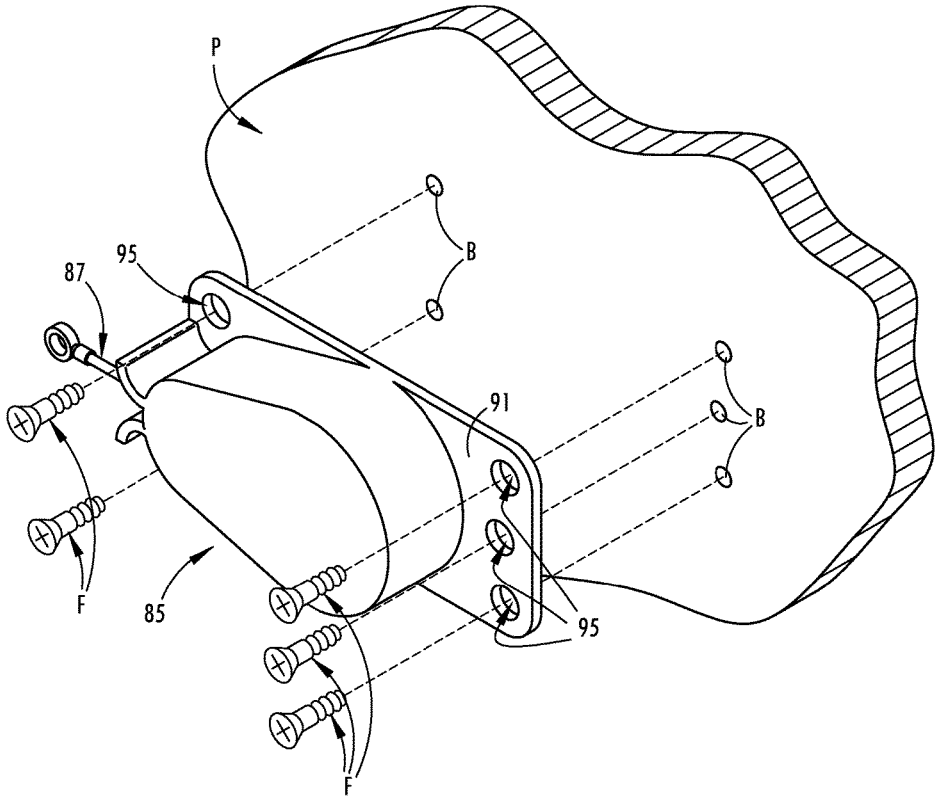
FIG. 14 is an exploded view of an exemplary subassembly including a panel and the cable tensioning device of FIG. 12.

As seen in FIGS. 14-15, the cable tensioning device 85 may be secured to the panel P. In an example, one or more fasteners F may be passed through the one or more attachment hardware bores 95 extending through the thickness $T_{91}$ of the base portion 91 of the cable tensioning device 85. The fasteners F may then be passed into one or more corresponding fastener bores B formed by a panel P for securing the cable tensioning device 85 to the panel P.

With reference to FIG. 15, after securing the cable tensioning device 85 to the panel P, the distal end $\mathbf{87}_D$ of the cable 87 may be pulled with a force according to the direction of the arrow X. Pulling the distal end $\mathbf{87}_D$ of the cable 87 with the force X results in at least a portion $L_{87\text{-}P}$ of the length $L_{87}$ of the cable 87 being drawn out of the cable-stowing housing 93; the length $L_{87}$ of the cable 87 extends between the distal end $\mathbf{87}_D$ of the cable 87 and the proximal end $\mathbf{87}_P$ of the cable 87.

Referring to FIGS. 16-17, the cable guide 10 may be secured to the panel P by passing a fastener F through the attachment hardware bore 20 and into a corresponding fastener bore B formed by the panel P. Alternatively, or, in addition to passing the fastener F through the attachment hardware bore 20 and into a corresponding fastener bore B formed by the panel P, each of the first attachment projection 22*a* and the second attachment projection 22*b* may be arranged within corresponding bores B formed by the panel P. As seen in FIG. 17, before and just after the cable guide 10 is secured to the panel P, the cable guide 10 is arranged in the first, "open orientation."

Figure 18:
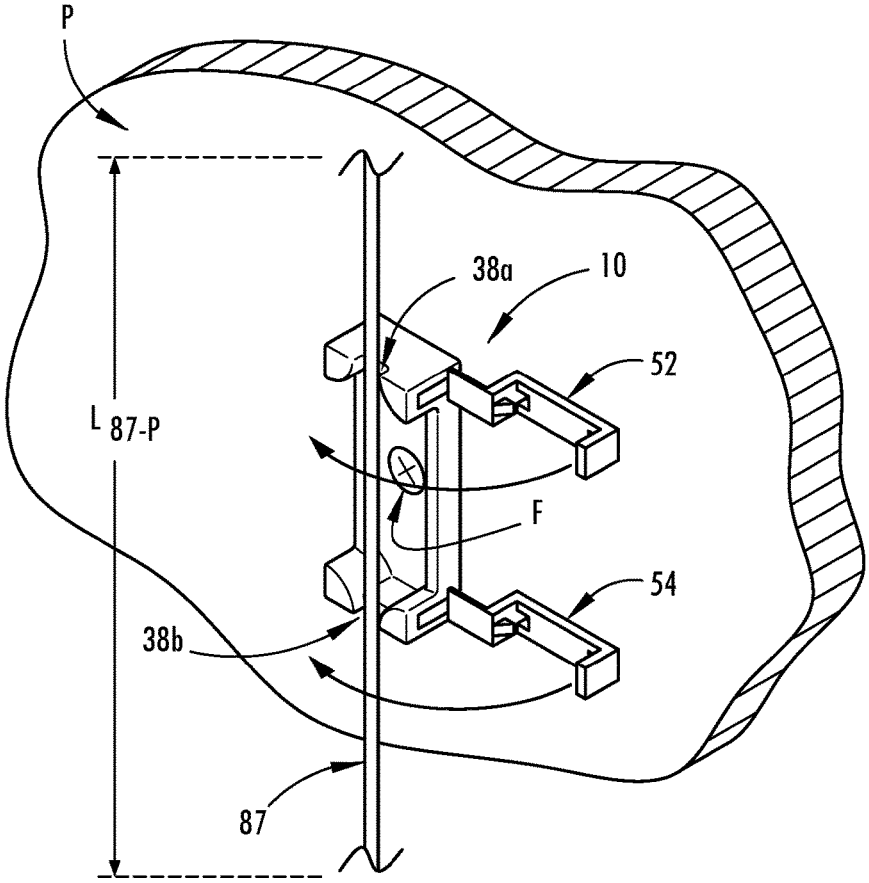
FIG. 18 is a view of the portion of the length of the cable of arranged upon the cable guide of FIG. 17 that is arranged in the first orientation of FIG. 1A whereby the cable guide does not secure the cable.
Figure 19:
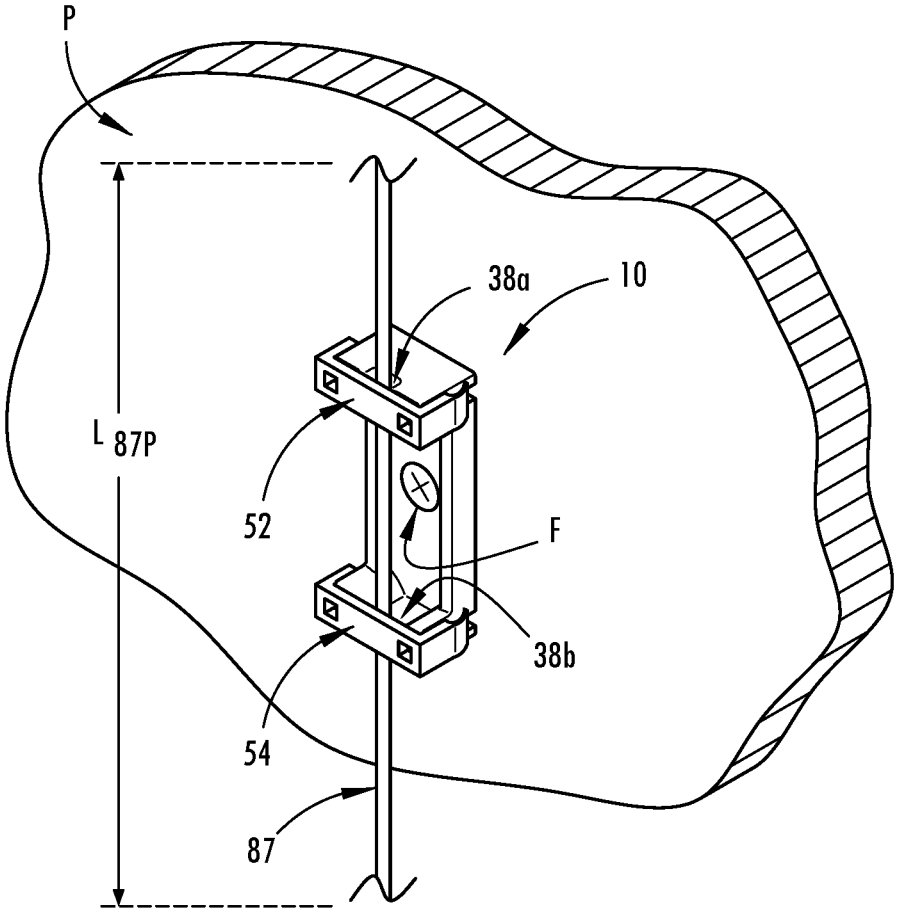
FIG. 19 is a view of the portion of the length of the cable arranged upon the cable guide of FIG. 17 that is arranged in the second orientation of FIG. 1B whereby the cable guide secures the cable.

Referring to FIGS. 17-19, portions (e.g., the cable 87 of the cable tensioning device 85 and at least one cable guide 10) of the implement interlock system 100 are interfaced with one another. Firstly, as seen in FIG. 17, while the cable guide 10 is arranged in the first, "open orientation," the portion $L_{87\text{-}P}$ of the length $L_{87}$ of the cable 87 is aligned with: (1) the cable-receiving passageway or slot 38*a* formed by the end portion 24*a* of the upper body portion 16 of the body 12 of the cable guide 10; and (2) the cable-receiving passageway or slot 38*b* formed by the end portion 24*b* of the lower body portion 18 of the body 12 of the cable guide 10. As seen in FIG. 18, the portion $L_{87\text{-}P}$ of the length $L_{87}$ of the cable 87 is disposed within each of the cable-receiving passageway or slots 38*a*, 38*b* while the cable guide 10 remains in the first, "open orientation." Then, as seen in FIG. 19, while the portion $L_{87\text{-}P}$ of the length $L_{87}$ of the cable 87 is disposed within each of the cable-receiving passageway or slots 38*a*, 38*b*, the cable guide 10 is transitioned from the first, "open orientation" to the second, "closed orientation" by respectively folding both of the upper cable-retaining body 52 and the lower cable-retaining body 54 over the end portions 24*a*, 24*b* of body 12 in order to retain the portion $L_{87\text{-}P}$ of the length $L_{87}$ of the cable 87 within the cable-receiving passageway or slots 38*a*, 38*b* formed by the cable guide 10.

Referring to FIG. 20, the methodology described in FIGS. 16-19 may be repeated several times for securing two or more cable guides 10 to the panel P, which, in an example, may be an article of furniture such as a dresser cabinet H, such that the two or more cable guides 10 are arranged in the second, "closed orientation" about a plurality of locations along the portion $L_{87\text{-}P}$ of the length $L_{87}$ of the cable 87. Furthermore, as seen in FIG. 20 as an example, the cable tensioning device 85 (including the proximal end $\mathbf{87}_P$ of the cable 87) may be secured near an upper end of the panel P, and, the distal end $\mathbf{87}_D$ of the cable 87 may be secured near a lower end of the panel P. Although the portion $L_{87\text{-}P}$ of the length $L_{87}$ of the cable 87 is shown at FIG. 20, an additional length of the portion $L_{87\text{-}P}$ of the length $L_{87}$ of the cable 87 is contained within the cable-stowing housing 93 in a wound orientation. As will be described in the following disclosure, the additional length of the portion $L_{87\text{-}P}$ of the length $L_{87}$ of the cable 87 may be drawn out of the cable-stowing housing 93 in response to movement of one or more of the implements/drawers $D_1$-$D_4$.

Figure 21:
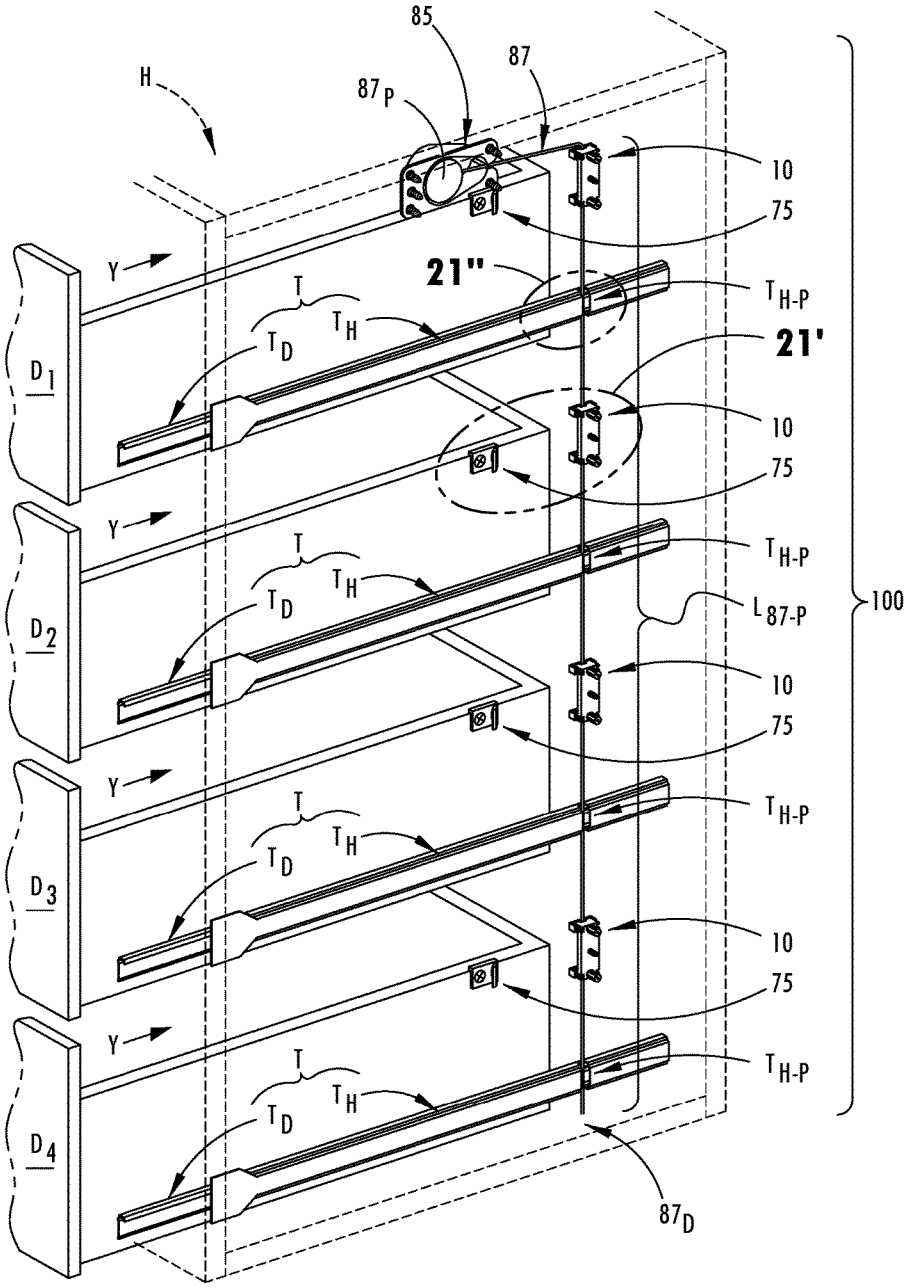
FIGS. 21-23 are perspective views of the cable engagement device of FIGS. 9-11 that is secured to a movable portion of the article of furniture FIG. 20 arranged relative to a portion of a length of a cable extending from the cable tensioning device of FIGS. 12-13 that is secured by the cable guide of FIGS. 1A-8B that is secured to a non-movable portion of the article of furniture of FIG. 20.
Figure 22:
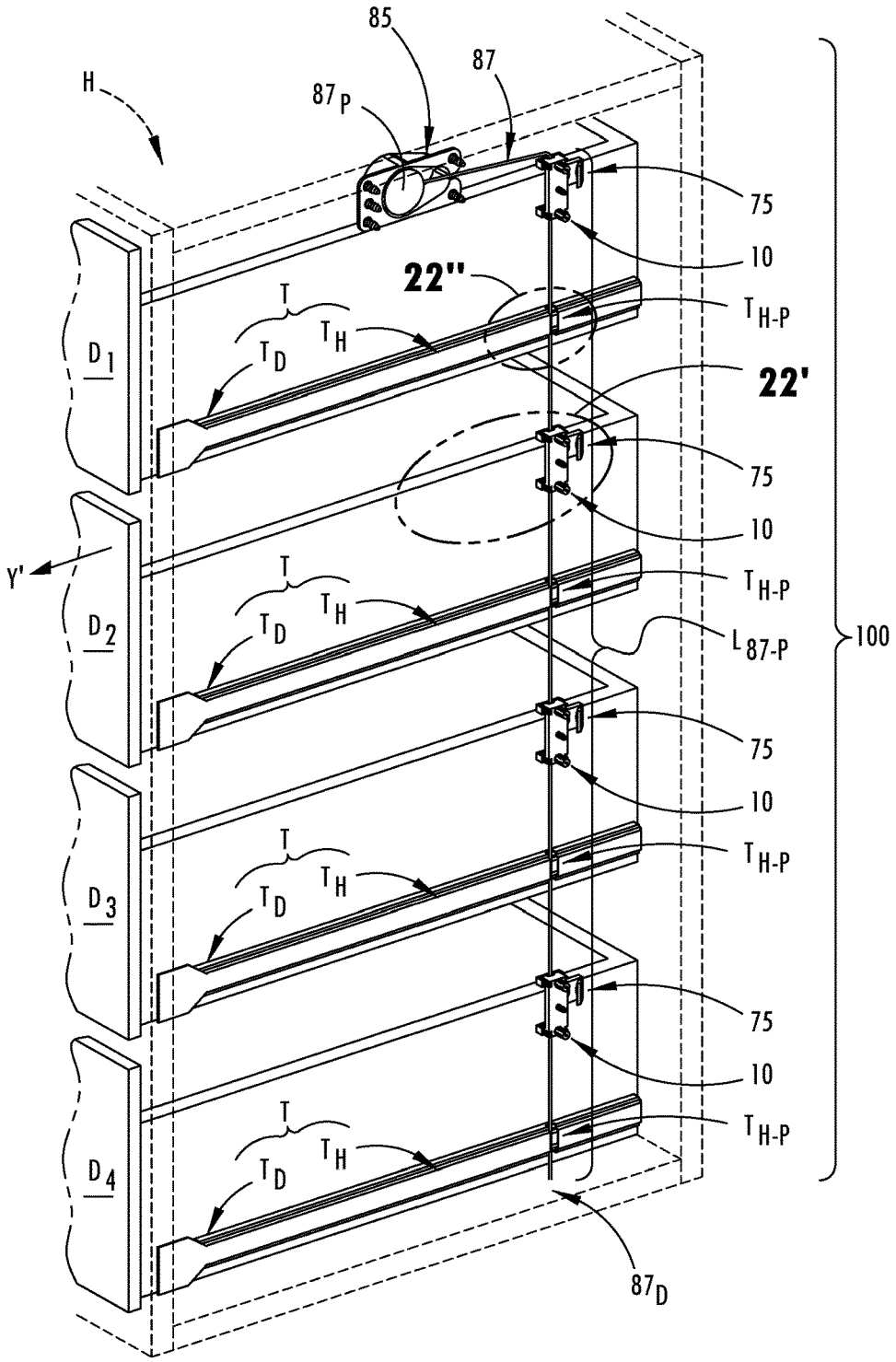
Figure 22:
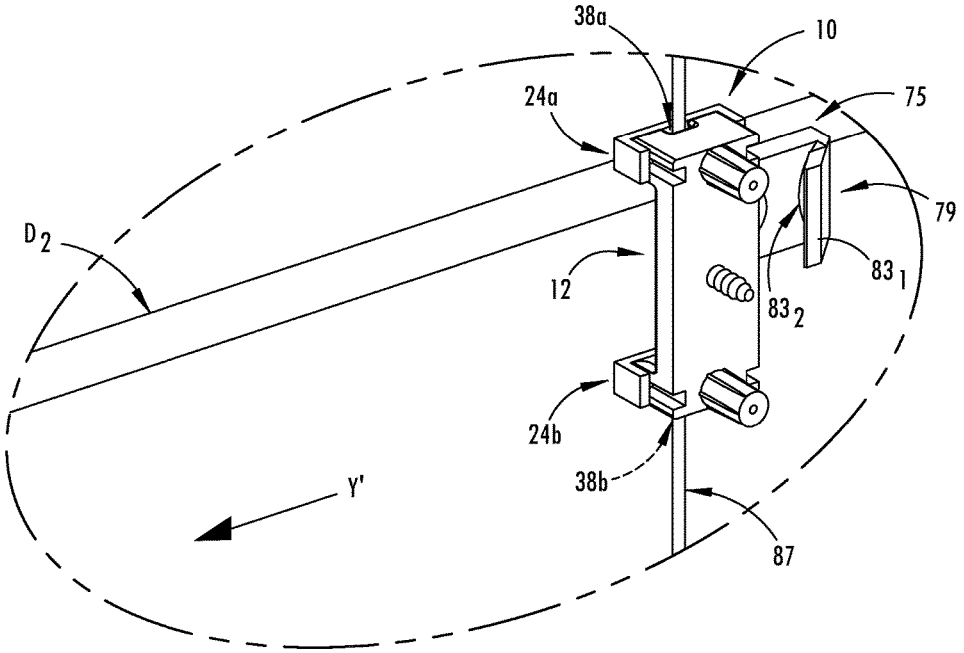
Figure 22:
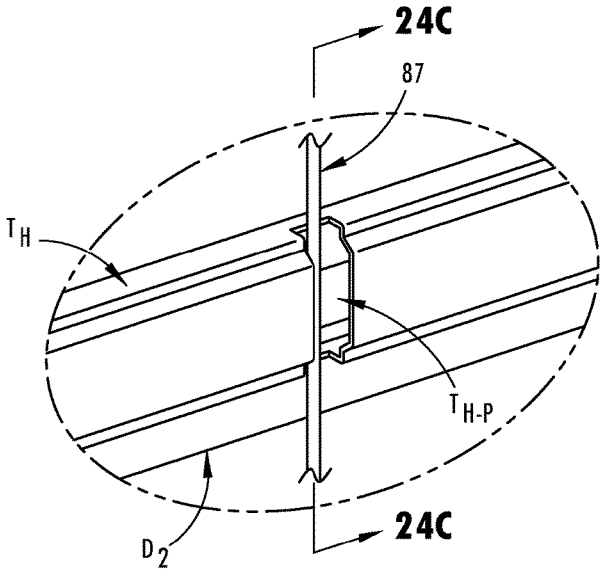

Referring to FIGS. 20-22, a method of interfacing at least one cable engagement device 75 in the implement interlock system 100 is now described. Firstly, as seen in FIG. 21', the locating ledge $\mathbf{83}_3$ of the cable engagement device 75 may be disposed upon an upper surface of an implement $D_2$; as described above, the implement $D_2$ may be a moveable component (e.g., a drawer) of an article of furniture H. Thereafter, a fastener F may be passed through the hardware bore 81 extending through the base portion 77 of the cable engagement device 75 for securing the cable engagement device 75 to the drawer $D_2$. As seen in FIG. 21', after attaching the cable engagement device 75 to the drawer $D_2$, and, upon slidably-disposing the drawer $D_2$, within the dresser cabinet H, the hook portion 79 of the cable engagement device 75 may be arranged for movement between the end portions 24*a*, 24*b* of body 12 of the cable guide 10 such that the hook portion 79 of the cable engagement device 75 may be subsequently interfaced with some of the portion $L_{87\text{-}P}$ of the length $L_{87}$ of the cable 87 that is secured by the cable guide 10 adjacent central body portion 14 of the cable guide 10.

Referring to FIG. 21, all of the drawers $D_1$-$D_4$ are shown slidably-joined to the dresser cabinet H. Slidability of the drawers $D_1$-$D_4$ relative to the dresser cabinet H may be achieved by a track system T formed from a first track member $T_D$ cooperating with a second track member $T_H$. Each drawer $D_1$-$D_4$ may include a pair of the first track members $T_D$ such that opposite outer side surfaces of each drawer $D_1$-$D_4$ includes one first track member $T_D$ of the pair of first track members $T_D$. The dresser cabinet H includes a plurality of pairs of second track members $T_H$ arranged on opposite inner side surfaces of the dresser cabinet H that receive each pair of first track members $T_D$ associated with each drawer $D_1$-$D_4$.

Figure 24A:
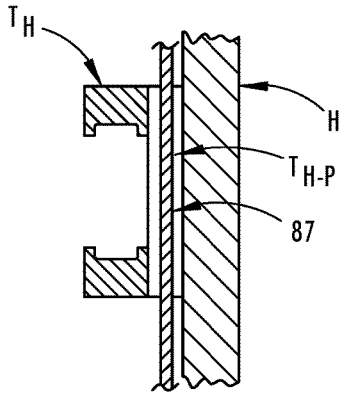
FIGS. 24A-24C are cross-sectional views of the interlock system according to lines 24A-24A of FIGS. 21" and 24C-24C of FIG. 22".
Figure 24B:
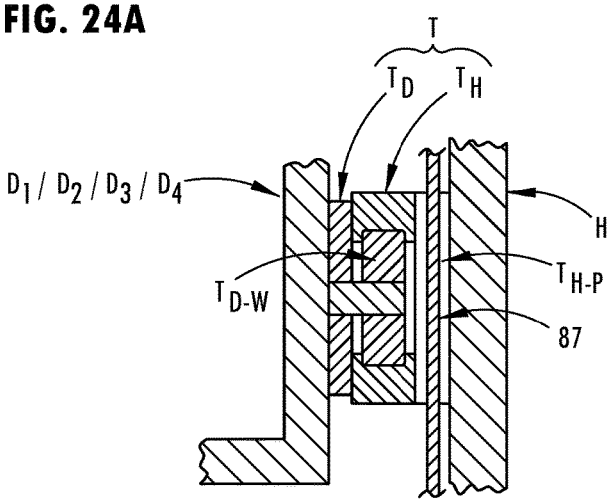
Figure 24C:
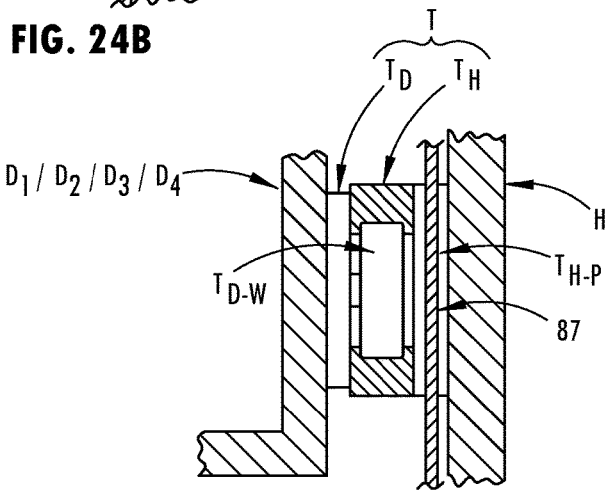

As seen in FIGS. 24B-24C, each first track member $T_D$ includes a wheel $T_{D\text{-}W}$ that is slidably-disposed within a channel formed by a C-shaped body of the second track member $T_H$. As shown in FIGS. 21, 21", 22, 22" and 24A-24C, in some implementations, at least one second track member $T_H$ of each pair of second track members $T_H$ attached to the dresser cabinet H forms a cable-receiving passage $T_{H-P}$ that is sized to permit the cable 87 to pass there-through. With reference to FIGS. 24A-24C, as a result of arranging the cable 87 within the cable-receiving passage $T_{H-P}$, movement of the cable 87 is permitted through the cable-receiving passage $T_{H-P}$. Although all of the drawers $D_1$-$D_4$ are shown in FIG. 21 being slidably-joined to the dresser cabinet H, all of the drawers $D_1$-$D_4$ are not yet shown in a selectively-attached state with respect to the portions (e.g., the cable 87 of the cable tensioning device 85 and two, or more cable guides 10) of the implement interlock system 100.

In an example, as seen in FIGS. 21 and 21', the hook portion 79 of the cable engagement device 75 has not yet been advanced according to the direction of arrow Y past a portion of the cable 87 extending between the end portions 24*a*, 24*b* of body 12 of the cable guide 10. As seen in FIGS. 22 and 22', after advancing the drawer $D_2$ further in the direction of arrow Y, the ramp surface $\mathbf{83}_1$ of the hook portion 79 engages the cable 87 such that the cable 87 subsequently slides over the hook portion 79 whereby the hook portion 79 is arranged past the cable 87.

Figure 23:
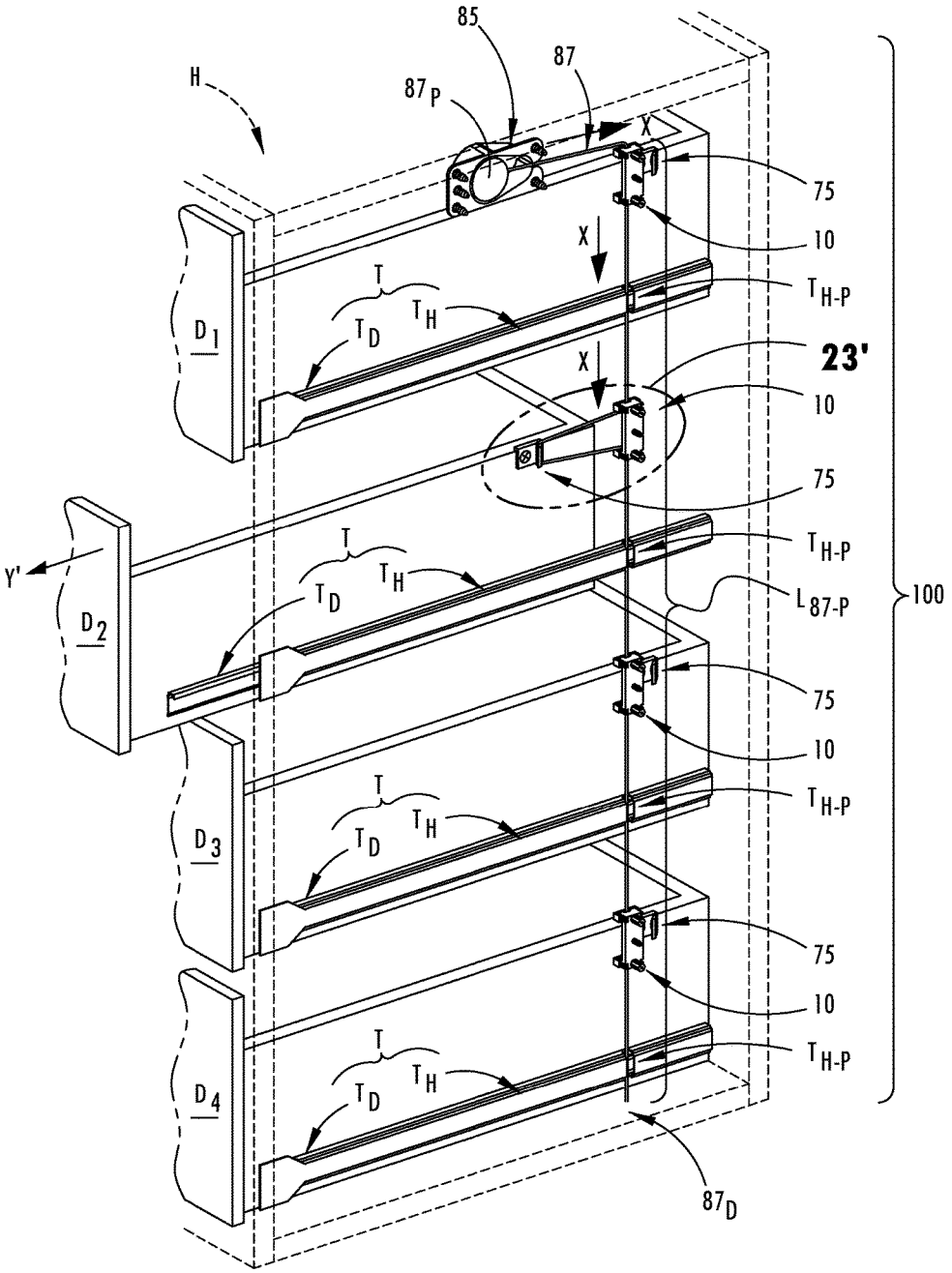
Figure 23:
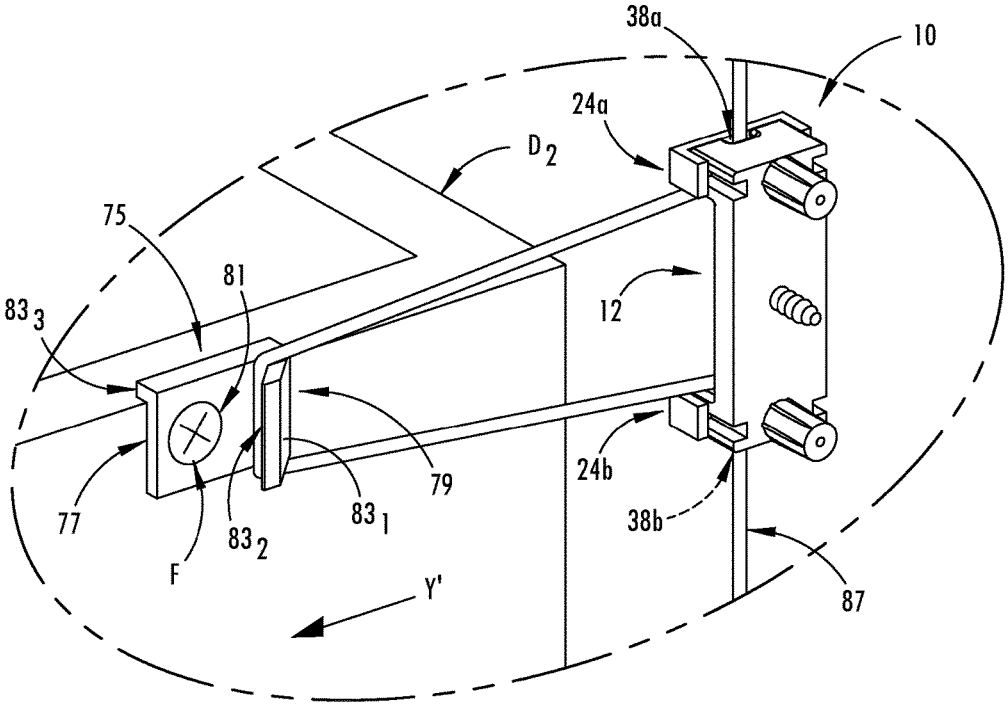

Referring to FIGS. 22-22' and 23-23', the drawer $D_2$ may then be slid in a direction according to arrow Y', which is opposite the direction of arrow Y. Referring to FIGS. 23 and 23', the movement of drawer $D_2$ according to arrow Y' results in the cable-pulling surface $\mathbf{83}_2$ of the hook portion 79 engaging and pulling the portion of the cable 87 extending between the end portions 24*a*, 24*b* of body 12 of the cable guide 10. Furthermore, the movement of drawer $D_2$ according to arrow Y' results in the cable-pulling surface $\mathbf{83}_2$ of the hook portion 79 applying a cable-pulling force X to the cable 87, thereby drawing out an additional amount of the portion $L_{87-P}$ of the length $L_{87}$ of the cable 87 that is stored within the cable-stowing housing 93 in a wound orientation. Yet even further, after the cable-pulling surface $\mathbf{83}_2$ applies the cable-pulling force X to the cable 87, the cable 87 is permitted to move within the cable-receiving passageway or slots 38*a*, 38*b* and against any of the curved or arcuate inner surfaces 40*a*/40*b*, 46*a*/46*b* of the first side portion 28*a*/28*b* or second side portion 30*a*/30*b*.

Figure 25A:
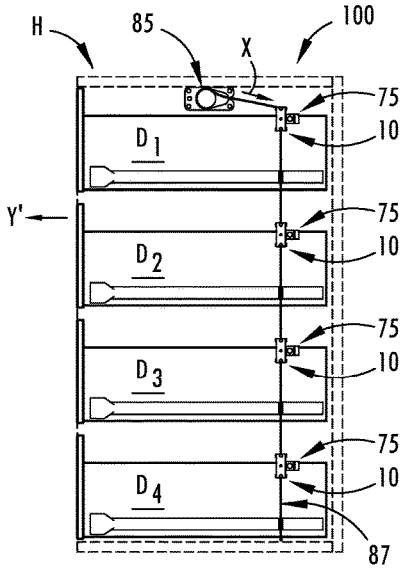
FIGS. 25A-25D illustrate a method for operating the interlock system secured to the article of furniture of FIGS. 21-23.

Referring to FIGS. 25A-25D, a method for operating the implement interlock system 100 is described. As seen in FIG. 25A, all of the drawers $D_1$-$D_4$ are arranged in a selectively-attached state with respect to the portions of the implement interlock system 100 such that the cable-pulling surface $\mathbf{83}_2$ of the hook portion 79 may apply a cable-pulling force X to the cable 87 when any of the drawers are moved according to the direction of arrow Y'.

Figure 25B:
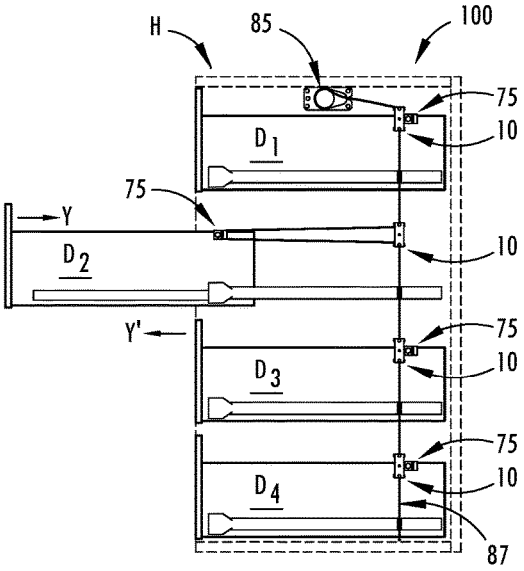

In an example, as seen in FIGS. 25A-25B, a user may wish to slide, according to the direction of arrow Y', the drawer $D_2$ outwardly from the dresser cabinet H while the remaining drawers $D_1$, $D_3$, $D_4$ remain nested within the dresser cabinet H. Accordingly, the drawer $D_2$ is slid outwardly Y' from the dresser cabinet H and the cable-pulling surface $\mathbf{83}_2$ of the hook portion 79 of the drawer $D_2$ applies a cable-pulling force X to the cable 87. Furthermore, with reference to FIG. 25B, the drawer $D_2$ may be said to be fully slid outwardly in the direction of arrow Y' from the dresser cabinet H, when a remaining amount of the portion $L_{87-P}$ of the length $L_{87}$ of the cable 87 that was stored within the cable-stowing housing 93 is reeled out of the cable-stowing housing 93.

Figure 25C:
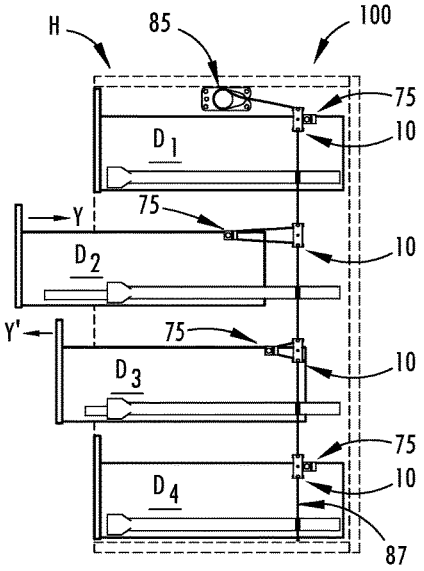
Figure 25D:
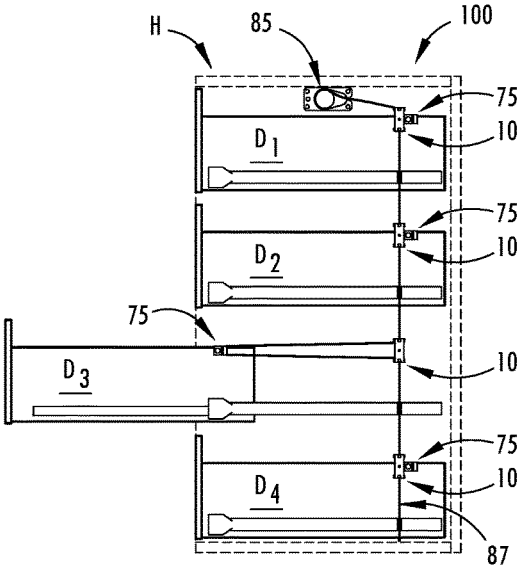

With reference to FIGS. 25B-25C, after fully sliding Y' the drawer $D_2$ outwardly from the dresser cabinet H, a user may attempt to slide Y' one of the nested drawers $D_1$, $D_3$, $D_4$ outwardly from a stowed orientation within the dresser cabinet H. Because all of the cable 87 had been reeled out of the cable-stowing housing 93 (as described above in response to fully extending Y' the drawer $D_2$), any outward movement Y' of another the drawer $D_1$, $D_3$, $D_4$ from the dresser cabinet H either will be prevented, retarded, or will cause the cable 87 to apply a pulling force according to the direction of arrow Y to the hook portion 79 of the fully extended drawer $D_2$ in order to thereby automatically withdraw or retract the fully-extended drawer $D_2$ back to a nest orientation within the dresser cabinet H. Therefore, as seen in FIGS. 25B-25D, movement of another drawer (e.g., drawer $D_3$) from a nested orientation (see, e.g., FIG. 25B) within the dresser cabinet H to a fully extended orientation outside of the dresser cabinet H (see, e.g., FIG. 25D), may result in the drawer $D_2$ being automatically retracted within the dresser cabinet H. Furthermore, when the user manually closes one or more of the extended drawers $D_1$, $D_2$, $D_3$, $D_4$ the cable tensioner 97 of the cable tensioning device 85 automatically retracts the reeled-out portion $L_{87-P}$ of the length $L_{87}$ of the cable 87 that had been stored within the cable-stowing housing 93 prior to extending one or more drawers $D_1$, $D_2$, $D_3$, $D_4$ outside of the dresser cabinet H.

In another aspect of the implement interlock system 100, a user may selectively remove one or more of the drawers $D_1$-$D_4$ from the dresser cabinet H such that the drawers $D_1$-$D_4$ are not permanently attached to the dresser cabinet H by way of the arrangement of the cable guides 10 and cable 87. For example, as seen in FIG. 23', a user may engage his/her finger with the cable 87 and move the cable 87 from the cable-pulling surface $\mathbf{83}_2$ in order to disconnect the cable 87 from the hook portion 79 of the cable engagement device 75 and thereby return the orientation of the cable 87 and the cable engagement device 75 back to the orientation shown at FIG. 21'. With the cable 87 no longer hooked about the hook portion 79 of the cable engagement device 75, the user may remove a corresponding "un-hooked" drawer $D_1$-$D_4$ from the dresser cabinet H.

With reference to FIG. 20, although the cable guides 10, cable engagement devices 75 and cable tensioning device 85 are shown fixed to various locations of the dresser cabinet H and drawers $D_1$-$D_4$, the locations of the cable guides 10, cable engagement devices 75 and cable tensioning device 85 including the cable 87 are not limited to what is shown at FIG. 20. For example, the cable guides 10, cable engagement devices 75 and cable tensioning device 85, collectively, may be positioned at the front, back, left side or right side of the dresser cabinet H and drawers $D_1$-$D_4$. In one embodiment, the cable guides 10, cable engagement devices 75, and the cable tensioning device 85 are located on the right-slide of panel P of dresser cabinet H about 3-5 inches from the front of dresser cabinet H (such that a user can outwardly slide a drawer $D_1$-$D_4$ from its nested position and reach his/her fingers into the dresser cabinet H to unhook the cable 87 from the cable engagement device 75, as described above).

Furthermore, although a "right side" view of the dresser cabinet H and drawers $D_1$-$D_4$ is seen at FIG. 20 showing one cable 87 being interfaced with a cable guide 10 and cable engagement device 75 corresponding to each drawer $D_1$-$D_4$, a second cable 87 may be provided on the "left side" of the dresser cabinet H that will correspondingly interfaced with "left side" cable guides 10 and cable engagement device 75 corresponding to each drawer $D_1$-$D_4$.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An implement interlock system for selectively attaching two or more implements in a slidable relationship with respect to a cavity defined by at least one panel that forms an implement housing, comprising:

a cable tensioning device including a cable, wherein the cable includes a proximal end and a distal end, wherein the proximal end of the cable is attached to the cable tensioning device, wherein the cable is defined by a length extending between the proximal end of the cable and the distal end of the cable;

a first cable guide including a first end and a second end, each end defining a cable-receiving passageway, wherein a first portion of the length of the cable extends between the first end and the second end of the first cable guide;

a second cable guide including a first end and a second end, each end defining a cable-receiving passageway, wherein a second portion of the length of the cable extends between the first end and the second end of the second cable guide;

a first cable engagement device that selectively-hooks the first portion of the length of the cable, wherein the first cable engagement device is configured for attachment to one of the implements; and a second cable engagement device that selectively-hooks the second portion of the length of the cable, wherein the second cable engagement device is configured for attachment to one of the implements.

2. The implement interlock system of claim 1, wherein each of the first cable guide and the second cable guide defines at least one attachment hardware bore that is sized for receiving at least one fastener for attaching each cable guide to the at least one panel.

3. The implement interlock system of claim 1, wherein each of the first cable guide and the second cable guide includes at least one attachment projection that is sized for being disposed within at least one attachment projection bore formed by the at least one panel.

4. The implement interlock system of claim 1, wherein the cable tensioning device includes a casing having a base portion and cable-stowing housing, wherein the base portion defines at least one attachment hardware bore extending through the base portion that is sized for receiving at least one fastener for attaching the cable tensioning device to the at least one panel.

5. The implement interlock system of claim 1, wherein the cable tensioning device includes a cable-stowing housing and a cable tensioner disposed within the cable-stowing housing, wherein the cable tensioner is connected to the cable for biasing the cable within the cable-stowing housing in a wound orientation.

6. The implement interlock system of claim 1, wherein a locating ledge of each of the first cable engagement device and the second cable engagement device is sized for interfacing with a surface of each implement of the two or more implements, wherein each cable engagement device defines a hardware bore that is sized for receiving a fastener that secures each cable engagement device to each implement of the two or more implements.

7. The implement interlock system of claim 1, wherein the first cable guide, the second cable guide, the cable tensioning device, and the distal end of the cable all are attached to the at least one panel; and wherein the first cable engagement device is attached to one implement of the two or more implements and the second cable engagement device is attached to another one of the two or more implements.

8. The implement interlock system of claim 7, further comprising:

two or more pairs of first track members, each implement of the two or more implements including one pair of the two or more pairs of first track members; and two or more pairs of second track members, wherein at least one second track member of each of the two or more pairs of second track members defines a cable-receiving passage, and wherein the cable extends through the cable-receiving passage.

9. The implement interlock system of claim 7, wherein the implement housing is a dresser cabinet, and wherein the two or more implements are two or more drawers slidably-disposed within the dresser cabinet.

10. The implement interlock system of claim 7, wherein the at least one panel defines at least one fastener bore that is sized for receiving at least one fastener that passes through at least one attachment hardware bore formed by the first cable guide or the second cable guide.

11. A furniture assembly, comprising:

an article of furniture including at least one panel defining an implement-receiving cavity;

two or more implements slidably-disposed within the implement-receiving cavity of the article of furniture; and an implement interlock system including a cable tensioning device attached to the at least one panel within the implement-receiving cavity, wherein the cable tensioning device includes a cable, wherein the cable includes a proximal end and a distal end, wherein the proximal end of the cable is attached to the cable tensioning device, wherein the cable is defined by a length extending between the proximal end of the cable and the distal end of the cable;

a first cable guide attached to the at least one panel within the implement-receiving cavity, wherein the first cable guide includes a first end and a second end, each end defining a cable-receiving passageway, wherein a first portion of the length of the cable extends between the first end and the second end of the first cable guide;

a second cable guide attached to the at least one panel within the implement-receiving cavity, wherein the second cable guide includes a first end and a second end, each end defining a cable-receiving passageway, wherein a second portion of the length of the cable extends between the first end and the second end of the second cable guide;

a first cable engagement device attached to one implement of the two or more implements, wherein the first cable engagement device selectively-hooks the first portion of the length of the cable; and a second cable engagement device attached to another implement of the two or more implements, wherein the second cable engagement device selectively-hooks the second portion of the length of the cable.

12. The furniture assembly of claim 11, wherein each implement of the two or more implements includes a pair of first track members and the article of furniture includes two or more pairs of second track members, wherein at least one second track member of each of the two or more pairs of second track members defines a cable-receiving passage, wherein the cable extends through the cable-receiving passage.

13. The furniture assembly of claim 11, wherein the article of furniture is a dresser cabinet, wherein the two or more implements are two or more drawers slidably-disposed within the dresser cabinet.

14. The furniture assembly of claim 11, wherein the at least one panel defines at least one fastener bore that is sized for receiving at least one fastener that passes through at least one attachment hardware bore formed by the first cable guide or the second cable guide.

15. The furniture assembly of claim 11, wherein the at least one panel defines at least one attachment projection bore that is sized for receiving at least one attachment projection extending from the first cable guide or the second cable guide.

16. The furniture assembly of claim 11, wherein the cable tensioning device includes a casing having a base portion and cable-stowing housing, wherein the base portion defines one or more attachment hardware bores extending through the base portion that is sized for receiving at least one fastener for attaching the cable tensioning device to the at least one panel.

17. The furniture assembly of claim 11, wherein the cable tensioning device includes a cable tensioner for biasing the cable within the cable-stowing housing in a wound orientation.

18. The furniture assembly of claim 11, wherein a locating ledge of the first cable engagement device is disposed upon a surface of one implement of the two or more implements, wherein the second cable engagement device is disposed upon a surface of another implement of the two or more implements, wherein the first cable engagement device defines a hardware bore that is sized for receiving a fastener that secures the first cable engagement device to one implement of the two or more implements, and wherein the second cable engagement device defines a hardware bore that is sized for receiving a fastener that secures the second cable engagement device to another implement of the two or more implements.

* * * * *